US008189027B2

(12) United States Patent
Miyadera et al.

(10) Patent No.: US 8,189,027 B2
(45) Date of Patent: May 29, 2012

(54) EXPOSURE UNIT, IMAGE FORMING APPARATUS AND IMAGE FORMING METHOD

(75) Inventors: Tatsuya Miyadera, Osaka (JP); Yoshiyuki Shimizu, Hyogo (JP); Hideyuki Masumoto, Osaka (JP); Takafumi Miyazaki, Osaka (JP); Kozo Yamazaki, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 588 days.

(21) Appl. No.: 12/392,201

(22) Filed: Feb. 25, 2009

(65) Prior Publication Data

US 2009/0220878 A1 Sep. 3, 2009

(30) Foreign Application Priority Data

Feb. 28, 2008 (JP) ..... 2008-048162
Jan. 22, 2009 (JP) ..... 2009-011935

(51) Int. Cl.
*B41J 27/00* (2006.01)

(52) U.S. Cl. ..... 347/261; 347/232; 347/241; 347/243; 347/244; 347/258; 347/259; 347/260

(58) Field of Classification Search ..... 347/232, 347/241, 243, 244, 258, 259, 260, 261
See application file for complete search history.

(56) References Cited

U.S. PATENT DOCUMENTS

| | | | | |
|---|---|---|---|---|
| 4,903,067 | A * | 2/1990 | Murayama et al. | 347/129 |
| 5,175,570 | A * | 12/1992 | Haneda et al. | 347/116 |
| 5,381,167 | A * | 1/1995 | Fujii et al. | 347/116 |
| 6,275,244 | B1 * | 8/2001 | Omelchenko et al. | 346/116 |
| 7,015,940 | B1 * | 3/2006 | Kimura | 347/250 |
| 2004/0227806 | A1 * | 11/2004 | Takakubo | 347/241 |
| 2008/0038024 | A1 | 2/2008 | Miyadera | |
| 2008/0069602 | A1 | 3/2008 | Miyadera | |
| 2008/0170868 | A1 | 7/2008 | Miyadera | |
| 2008/0212986 | A1 | 9/2008 | Miyadera | |

FOREIGN PATENT DOCUMENTS

| | | |
|---|---|---|
| JP | 2004-086088 | 3/2004 |
| JP | 2007-133085 | 5/2007 |

* cited by examiner

*Primary Examiner* — Ryan Lepisto
(74) *Attorney, Agent, or Firm* — IPUSA, PLLC

(57) ABSTRACT

An exposure unit which exposes photoconductive drums having rotary axes thereof arranged parallel to each other on a single plane by light beams, includes one or more polygon mirrors each having a plurality of reflection surfaces, where the one or more polygon mirrors rotate about a common rotary axis. Each light beam is deflected by the one or more polygon mirrors and scans the surface of a corresponding photoconductive drum. The common rotary axis is separated from the rotary axes of the photoconductive drums by identical distances along respective normals which are perpendicular to both the common rotary axis and the rotary axes of the photoconductive drums.

23 Claims, 13 Drawing Sheets

EXPOSURE UNIT, IMAGE FORMING APPARATUS AND IMAGE FORMING METHOD

BACKGROUND OF THE INVENTION

1. Field of the Invention

The present invention generally relates to exposure units, image forming apparatuses and image forming methods for forming an image by overlapping a plurality of color images using the electrophotography technique, and more particularly to an exposure unit, an image forming apparatus and an image forming method which form positional error correction patterns and correct positional errors of image forming positions of different colors by irradiating light on the positional error correction patterns and detecting the reflected light.

2. Description of the Related Art

A tandem type image forming apparatus has a plurality of image forming units for forming images of different colors, such as black, cyan, magenta and yellow images. A full color image is formed by overlapping color toner images formed by the image forming units.

In the tandem type image forming apparatus, the image forming positions of the image forming units, that is, the positions where the toner images of different colors are overlapped, deviate and do not match to cause the so-called color registration error. Consequently, it is impossible to obtain a stable full color image due to the color registration error. In order to correct the color registration error, the conventional image forming apparatus forms positional error correction patterns corresponding to the different colors, and detects the positions of the positional error correction patterns by a pattern detecting means such as an image sensor. The color registration error is corrected by controlling the overlapping positions of the positional error correction patterns corresponding to the different colors so that the overlapping positions match. As a result, the color registration error of the full color image caused by the positional errors of the image forming positions of the different colors is reduced in the image forming apparatus, to enable a more stable or high-quality full color image to be formed.

In another conventional image forming apparatus, the image forming units are configured to enable the more stable full color image to be formed. However, the structure of such image forming units is complex, and thereby increases the size of the image forming apparatus as a whole. A Japanese Laid-Open Patent Publication No. 2004-86088 proposes an image forming apparatus which can prevent such a size increase of the image forming apparatus. According to the proposed image forming apparatus, the exposure unit includes a plurality of scanner units each having a polygon mirror and a deflection mirror. Lights emitted from the plurality of scanner units irradiate a plurality of image bearing members. The plurality of scanner units are provided on the same vertical plane in order to accurately position the scanner units using a simple structure. This scanner unit arrangement stabilizes the quality of the full color image that is formed, and also reduces the mounting area of the scanner units within the image forming apparatus to thereby reduce the size of the image forming apparatus.

However, in the conventional image forming apparatuses, when a certain time elapses after correcting the positional errors of the image forming positions of the different colors, the positional errors are generated again due to various causes. For this reason, it is necessary to periodically perform the positional error correction.

Among other things, one cause of the positional errors that are generated when the certain time elapses after correcting the positional errors may be attributed to the positional errors of deflection mirrors that occur due to a temperature rise within the exposure unit.

The deflection mirror is fixed on a support member within the exposure unit using screws or an adhesive agent. But when the temperature within the exposure unit rises, the shape of the support member or parts used to secure the deflection mirror is deformed by the temperature rise within the exposure unit, and the inclination of the deflection mirror changes with respect to an optical path of the light irradiating the image bearing member.

When the temperature within the exposure unit rises, the amount of positional error increases within a relatively short time, and consequently, the positional errors need to be corrected at relatively frequent intervals. But while the positional errors are being corrected, the image forming apparatus cannot perform an image forming operation, and during this time, a user will regard this time as a down-time of the image forming apparatus. The presence of such a down-time deteriorates the performance of the image forming apparatus from the point of view of the user.

In order to reduce the down-time described above, it is necessary to prevent the amount of positional error from increasing with the temperature rise within the exposure unit, and to reduce the intervals at which the positional errors are corrected. However, no measures are taken in the conventional image forming apparatuses in order to prevent the amount of positional error from increasing with the temperature rise within the exposure unit, and to reduce the intervals at which the positional errors are corrected.

SUMMARY OF THE INVENTION

Accordingly, it is an object in one aspect of the present invention to provide a novel and useful exposure unit, image forming apparatus and image forming method, in which the problems described above are suppressed.

Another and more specific object in one aspect of the present invention is to provide an exposure unit, an image forming apparatus and an image forming method, which prevent the amount of positional error from increasing due to a temperature rise.

According to one aspect of the present invention, there is provided an exposure unit, an image forming apparatus and an image forming method, which irradiates reflected light from a polygon mirror onto a surface of a photoconductive drum without being intermediated by a deflection mirror.

According to one aspect of the present invention, there is provided an exposure unit for exposing a plurality of photoconductive drums having rotary axes thereof arranged parallel to each other on a single plane by a plurality of light beams, where each of the plurality of photoconductive drums has a surface to be exposed when forming an electrostatic latent image thereon, comprises one or a plurality of polygon mirrors each having a plurality of reflection surfaces, where the one or the plurality of polygon mirrors is configured to rotate about a common rotary axis, wherein each of the plurality of light beams is deflected by the one or a corresponding one of the plurality of polygon mirrors and scans the surface of a corresponding one of the plurality of photoconductive drums, and the common rotary axis of the one of the plurality of polygon mirrors is separated from the rotary axes of the plurality of photoconductive drums by identical distances along respective normals which are perpendicular to both the common rotary axis and a corresponding one of the plurality of rotary axes.

According to one aspect of the present invention, an image forming apparatus comprises the above described exposure unit which is in accordance with one aspect of the present invention.

According to one aspect of the present invention, an image forming method forms an image using the above described exposure unit which is in accordance with one aspect of the present invention.

Other objects and further features of the present invention will be apparent from the following detailed description when read in conjunction with the accompanying drawings.

DESCRIPTION OF THE PREFERRED EMBODIMENTS

Figure 1:
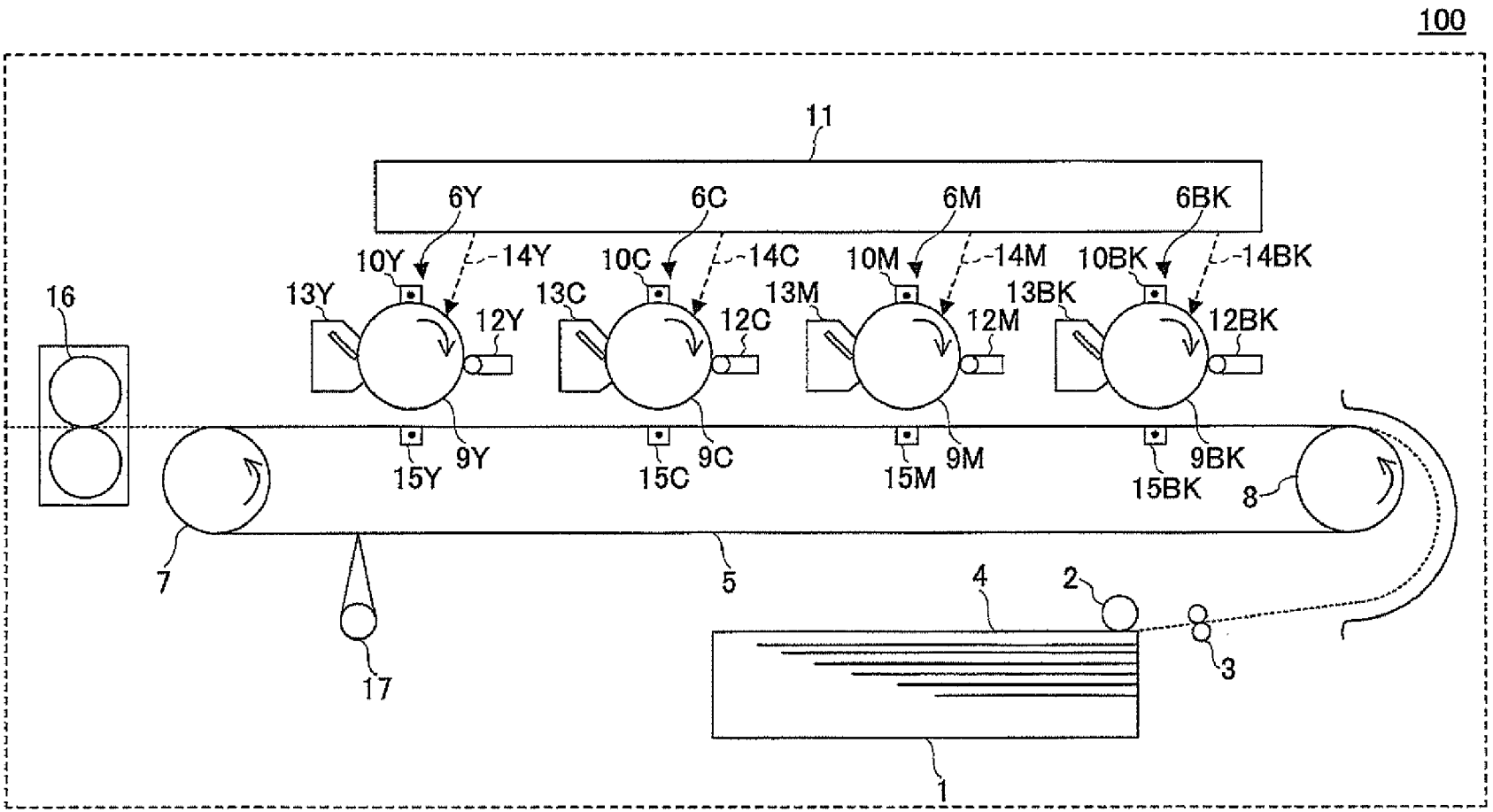
FIG. 1 is a diagram showing an example of a hardware structure of an image forming apparatus employing the tandem system in a first embodiment of the present invention.

A description will be given of embodiments of an exposure unit, an image forming apparatus and an image forming method according to the present invention, by referring to the drawings.

In the following description, those parts which are the same but are related to image formations of different colors, which include primaries, are designated by the same reference numerals with different affixes, where affixes "BK", "M", "C" and "Y" respectively indicate that the parts are related to the black, magenta, cyan and yellow image formations. Furthermore, the affixes to the reference numerals are omitted in the description where the color of the image formation need not be specified.

[First Embodiment]

Hardware Structure:

First, a description will be given of a hardware structure of an image forming apparatus 100 in a first embodiment of the present invention. FIG. 1 is a diagram showing an example of the hardware structure of the image forming apparatus 100 employing the tandem system in this first embodiment of the present invention.

Tandem Type Image Forming Apparatus:

As shown in FIG. 1, the image forming apparatus 100 includes image forming units (or electrophotography process units) 6BK, 6M, 6C and 6Y for the formation of black, magenta, cyan and yellow images. Each image forming unit 6 includes a photoconductive drum 9 which forms an image bearing member, and a charging unit 10, a developing unit 12, a photoconductive drum cleaner (not shown), and a discharge unit 13 which are arranged in a periphery of the photoconductive drum 9. The image forming unit 6 forms a toner image of a corresponding color.

In the image forming apparatus 100, the image forming units 6BK, 6M, 6C and GY for the formation of the corresponding colors are arranged along an upper path of a transport belt 5 which forms an endless moving member or means. For example, the image forming units 6BK, 6M, GC and 6Y for the formation of black, magenta, cyan and yellow toner images are successively arranged from an upstream end towards a downstream end in this order along a transport direction in which a recording medium 4, such as paper, is transported by the transport belt 5 in FIG. 1. A full color image is formed by overlapping the black, magenta, cyan and yellow toner images formed by the image forming units 6BK, 6M, 6C and 6Y.

Image Forming Operation:

In the image forming apparatus 100, the charging unit 10 uniformly charges the surface of the photoconductive drum 9 in the dark. Then, the exposure unit 11 emits a laser beam (or, laser light or exposure beam) 14 which irradiates and exposes the surface of the photoconductive drum 9, to form an electrostatic latent image for the corresponding color on the surface of the photoconductive drum 9.

Next, the developing unit 12 of the image forming apparatus 100 develops the electrostatic latent image on the surface of the photoconductive drum 9. As a result, the electrostatic latent image on the surface of the photoconductive drum 9 is formed or, made visible, into a toner image of the corresponding color.

Exposure Unit:

A description will be given of an exposure unit 11-1 which may be used as the exposure unit 11 of the image forming apparatus 100.

Figure 2:
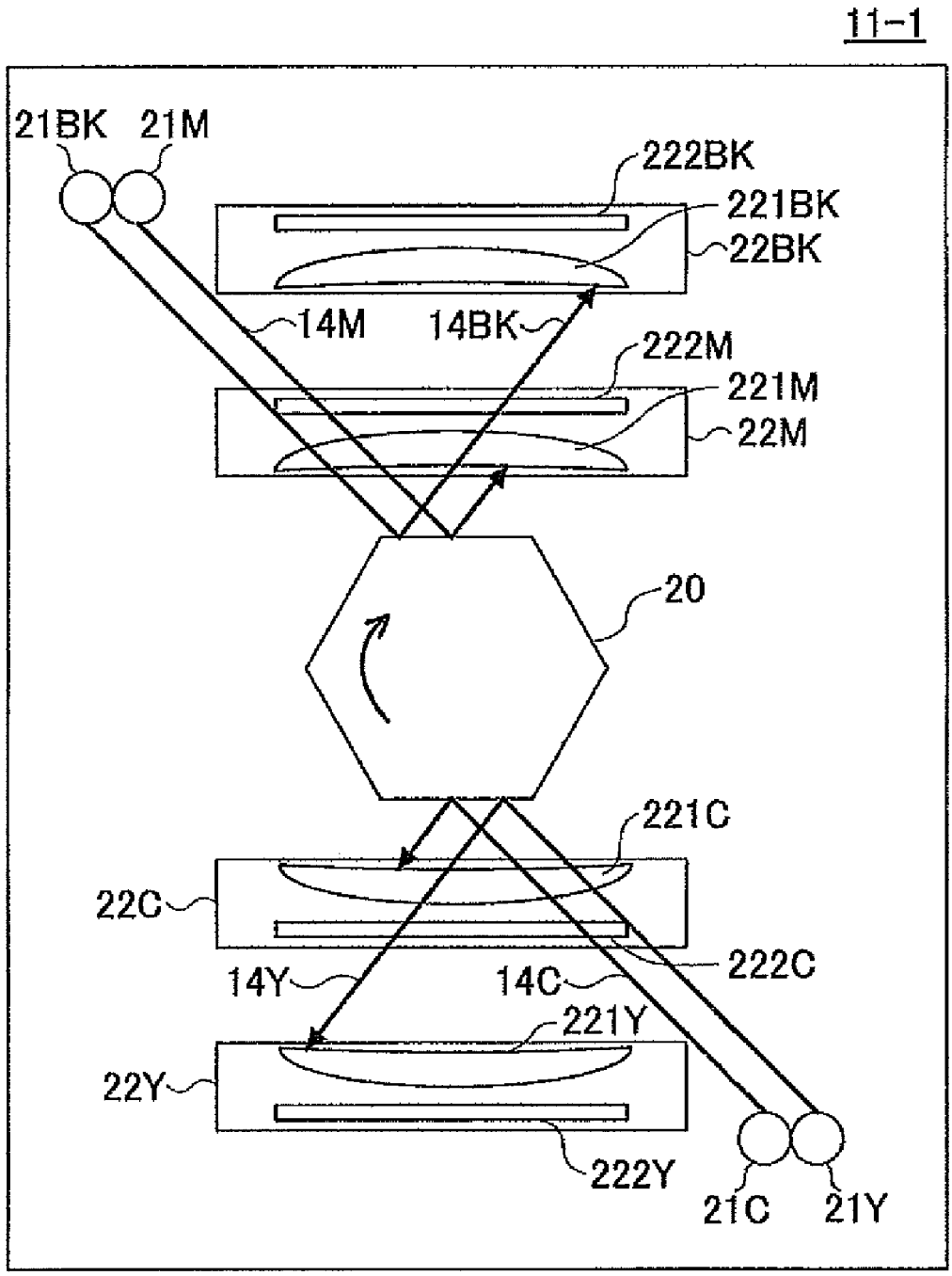
FIG. 2 is a diagram showing an example of an internal structure of an exposure unit.

FIG. 2 is a diagram showing an example of an internal structure of the exposure unit 11-1. A polygon mirror 20 has six reflection surfaces in this example, and reflects or deflects the laser beam 14 irradiated thereon while the polygon mirror 20 rotates. In this example, both laser beams 14BK and 14M for the black and magenta image formation are reflected by a first reflection surface of the polygon mirror 20, and both laser beams 14C and 14Y for the cyan and yellow image formation are reflected by a second reflection surface of the polygon mirror 20 located on the opposite side of the first reflection surface.

An optical system 22 of the exposure unit 11-1 includes fθ-lenses 221 and deflection mirrors 222. The fθ-lens 221 aligns the reflected laser beam from the polygon mirror 20 into equally spaced intervals. The deflection mirror 222 deflects an optical path of the laser beam 14 transmitted through the fθ-lens 221 towards the surface of the photoconductive drum 9.

As shown in FIG. 2, the laser beam 14 emitted from a laser diode 21, which forms a light source, is reflected by the reflection surface of the polygon mirror 20 and is input to the optical system 22. In the optical system 22, the input laser beam 14 is transmitted through the fθ-lens 221 and the optical path of the laser beam 14 is deflected by the deflection mirror 222 towards the surface of the photoconductive drum 9. As a result, the exposure unit 11-1 forms the electrostatic latent image on the surface of the photoconductive drum 9.

Returning now to the description of FIG. 1, the recording medium 4 is supplied from a supply tray 1 by a supply roller 2 and a separation roller 3. The recording medium 4 supplied from the supply tray 1 is adhered on the transport belt 5 by electrostatic suction, and is transported in the transport direction to successively confront the image forming units 6BK, 6M, 6C and 6Y. The transport belt 5 is supplied between a driving roller 7 and a following roller 8. The transport belt 5 is driven to rotate together with the following roller 8 when the driving roller 7 is driven by a driving motor (not shown).

The toner image formed by the developing unit 12 of the image forming unit 6 is transported from the photoconductive drum 9 onto the recording medium 4 on the transport belt 5, by the action of a transfer unit 15, at a transfer position where the photoconductive drum 9 and the recording medium 4 on the transport belt 5 make contact.

In the image forming apparatus 100, the black toner image is first transported onto the recording medium 4 by the image forming unit 6BK when the recording medium 4 reaches the transfer position confronting the image forming unit OBK. Then, the magenta toner image is transferred onto the recording medium 4 bearing the black toner image when the recording medium 4 reaches the transfer position confronting the image forming unit 6M. Thereafter, the cyan toner image is transferred onto the recording medium 4 bearing the overlapping black and magenta toner images when the recording medium 4 reaches the transfer position confronting the image forming unit 6C. Finally, the yellow toner image is transferred onto the recording medium 4 bearing the overlapping black, magenta and cyan toner images when the recording medium 4 reaches the transfer position confronting the image forming unit 6Y. As a result, a full color toner image is formed on the recording medium 4.

Next, the recording medium 4 bearing the full color image is separated from the transport belt 5 and is transported to a fixing unit 16 which fixes the full color toner image on the recording medium 4. The recording medium 4 bearing the full color image, which is fixed, is ejected outside the image forming apparatus 100.

When the toner image on the photoconductive drum 9 is transferred onto the recording medium 4, the surface of the photoconductive drum 9 is cleaned by a photoconductive drum cleaner (not shown) to remove residual and unwanted toner remaining on the surface of the photoconductive drum 9. The cleaned surface of the photoconductive drum 9 is then discharged by the discharge unit 13 in order to put the photoconductive drum 9 in a standby state ready to make the next image formation.

The image forming apparatus 100 forms the full color image on the recording medium 4 by the image forming operation described above.

Positional Error Correction:

Next, a description will be given of a positional error correction performed in the image forming apparatus 100.

Color Registration Error Caused By Positional Error Component:

In the image forming apparatus 100, a color registration error is generated if the overlapping positions of the black, magenta, cyan and yellow toner images do not match perfectly due to the positional errors of the black, magenta, cyan and yellow toner images formed on the recording medium 4. The quality of the full color image on the recording medium 4 deteriorates if such a color registration error is generated. For example, the causes of the positional error include an error in separation distances among rotary axes of the photoconductive drums 9BK, 9M, 9C and 9Y, an error in parallel orientations of the photoconductive drums 9BK, 9M, 9C and 9Y due to mounting positions thereof, an error in write timings of electrostatic latent images on the photoconductive drums 9BK, GM, 9C and 9Y, and an error in a mounting position of the deflection mirror 222 within the exposure unit 11-1.

A positional error component for each of the colors black, magenta, cyan and yellow mainly includes a skew, a registration error in a sub scan direction SS, a magnification (or zoom) error in a main scan direction MS, and a registration error in the main scan direction MS.

Method of Detecting and Correcting Each Positional Error:

In this embodiment, the image forming apparatus 100 corrects the positional error of the toner image of each color in the following manner. That is, the positional error is corrected by matching the toner image forming positions of the magenta, cyan and yellow toner images with respect to the toner image forming position of the black toner image.

Figure 3:
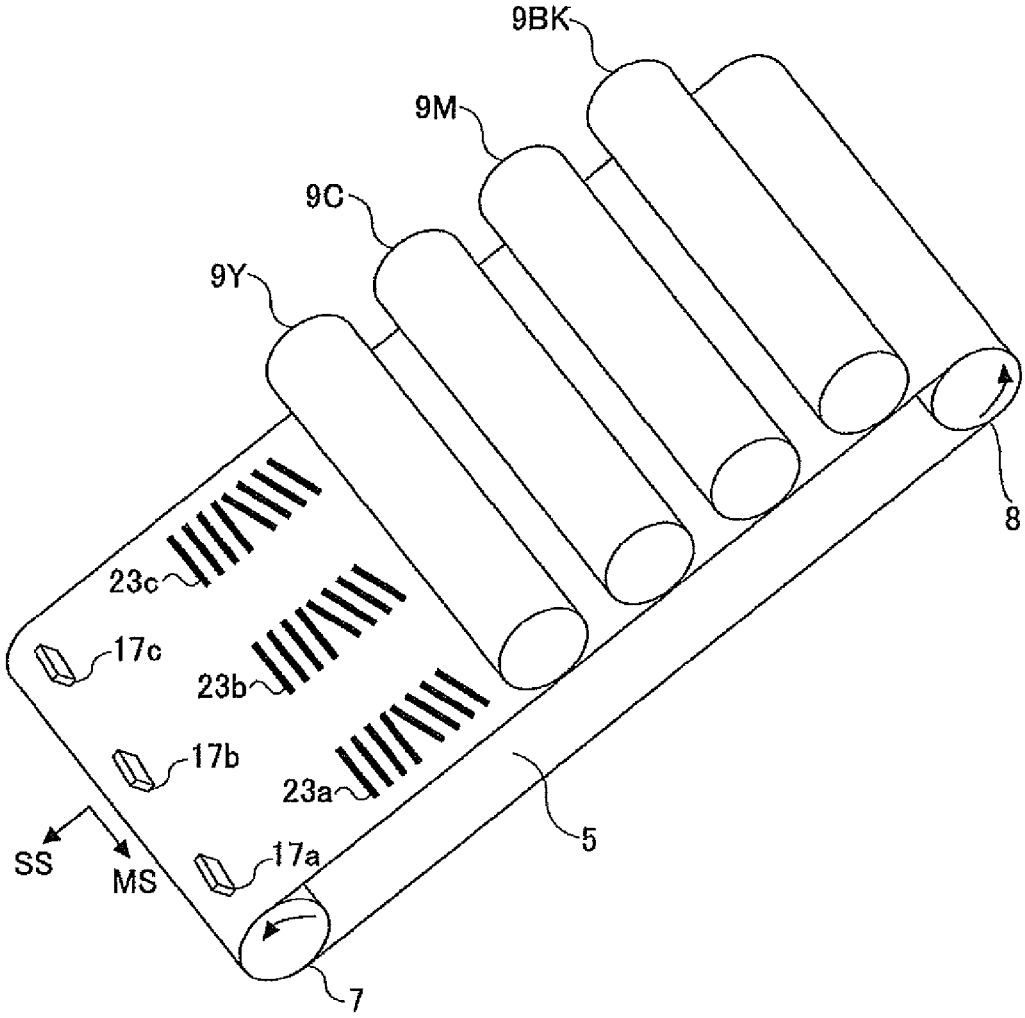
FIG. 3 is a perspective view showing an example of a structure of sensors for positional error correction and peripheral parts of the sensors.

FIG. 3 is a perspective view showing an example of a structure of sensors for positional error correction and peripheral parts of the sensors. As shown in FIG. 3, toner mark sensors 17*a*, 17*b* and 17*c* are provided on the downstream side of the image forming unit 6Y in the transport direction of the recording medium 4, at positions confronting the transport belt 5. The sensors 17*a*, 17*b* and 17*c* are supported on the same substrate (not shown) and are arranged along the main scan direction MS which is perpendicular to the sub scan direction SS. The sub scan direction SS corresponds to the transport direction of the recording medium 4. The sensors 17*a*, 17*b* and 17*c* optically detect corresponding positional error correction patterns 23*a*, 23*b* and 23*c* which are formed on the transport belt 5. Each of the positional error correction patterns 23*a*, 23*b* and 23*c* include black, magenta, cyan and yellow patterns which are formed on the transport belt 5 by the image forming units 6BK, 6M, 6C and GY. Because the sensors 17*a*, 17*b* and 17*c* are respectively disposed on both sides and at an approximate center along the main scan direction MS, the positional error correction patterns 23*a*, 23*b* and 23*c* are formed at the corresponding positions on the transport belt 5.

The positional error correction obtains the image forming positions of the positional error correction patterns 23*a*, 23*b* and 23*c* from the detection results of the sensors 17*a*, 17*b* and 17*c*, and performs a predetermined computation process by a central processing unit (CPU) or the like provided in an engine controller, for example. Consequently, it is possible to obtain the skew, the registration error in the sub scan direction SS, the magnification (or zoom) error in the main scan direction MS, and the registration error in the main scan direction MS. The predetermined computation based on the image forming positions of the positional error correction patterns 23*a*, 23*b* and 23*c* may be performed by a known technique, for example. In addition, the positional error correction performs the following correction based on the computation results.

The skew may be corrected by a known method which tilts the deflection mirror 222 within the exposure unit 11-1 or tilts the exposure unit 11-1 itself using an actuator (not shown), for example. The registration error in the sub scan direction SS may be corrected by a known method which controls the write timing of the main scan line or the phase of the reflection surfaces of the polygon mirror 20, for example. The magnification (or zoom) error in the main scan direction MS may be corrected by a known method which changes a write pixel frequency, for example. The registration error in the main scan direction MS may be corrected by a known method which changes the write timing of the main scan line, for example.

Therefore, in the image forming apparatus 100, the toner images of the positional error correction patterns 23*a*, 23*b* and 23*c* are formed on the transport belt 5, and the image forming positions of the positional error detection patterns 23*a*, 23*b* and 23*c* are detected by the corresponding sensors 17*a*, 17*b* and 17*c* which are disposed at the positions described above. Hence, the image forming apparatus 100 performs the predetermined computation process based on the detection results of the sensors 17*a*, 17*b* and 17*c* and performs the positional error correction based on the computation results.

Effects of Frequent Positional Error Correction:

The color registration errors are corrected by the positional error correction, and thus, a high-quality full color image can be formed. However, when a certain time elapses after correcting the positional errors of the image forming positions of the different colors, the positional errors are generated again due to various causes.

Among other things, one cause of the positional errors that are generated when the certain time elapses after performing the positional error correction may be attributed to the change in the inclination of the deflection mirror 222 that occurs due to a temperature rise within the exposure unit 11-1. The deflection mirror 222 is fixed to a predetermined position within the exposure unit 11-1 using a support member within the exposure unit 11-1 using screws or an adhesive agent. However, when the image forming operation continues, the temperature within the exposure unit 11-1 rises due to heat generated from the fixing unit 16 and the polygon mirror 200. When the temperature within the exposure unit 11-1 rises, the shape of the support member or parts used to secure the deflection mirror 222 is deformed by the temperature rise within the exposure unit 11-1, and the inclination of the deflection mirror 222 changes with respect to the optical path of the laser beam 14 to thereby increase the amount of positional error.

When the temperature within the exposure unit 11-1 rises, the amount of positional error increases within a relatively short time, and consequently, the positional error needs to be corrected at relatively frequent intervals. But while the positional error is being corrected, the image forming apparatus 100 cannot perform the image forming operation, and during this time, the user will regard this time as a down-time of the image forming apparatus 100. The presence of such a down-time deteriorates the performance of the image forming apparatus 100 from the point of view of the user.

Reducing Intervals of Positional Error Correction:

In order to reduce the down-time described above, it is necessary to prevent the amount of positional error from increasing with the temperature rise within the exposure unit 11-1, and to reduce the intervals at which the positional error is corrected. Hence, this embodiment prevents the amount of positional error from increasing due to the temperature rise within the exposure unit 11, by omitting the deflection mirror 222 which causes the amount of positional error to increase.

In other words, in the exposure unit 11-1 shown in FIG. 2, the laser beam 14 is deflected by the deflection mirror 222 and directed towards the photoconductive drum 9 to irradiate the surface of the photoconductive drum 9.

On the other hand, this embodiment uses, in place of the exposure unit 11-1, the exposure unit 11 which directs the laser beam 14 towards the photoconductive drum 9 without the use of the deflection mirror 222 which causes the amount of positional error to increase, as will be described later.

By omitting the deflection mirror 222 within the exposure unit 11, the intervals at which the positional error needs to be corrected can be reduced, and as a result, it is possible to reduce the down-time of the image forming apparatus 100 caused by the positional error correction. Therefore, it is possible to form a stable full color image having a high quality without deteriorating the performance of the image forming apparatus 100 from the point of view of the user, at a satisfactory processing speed.

Figure 4:
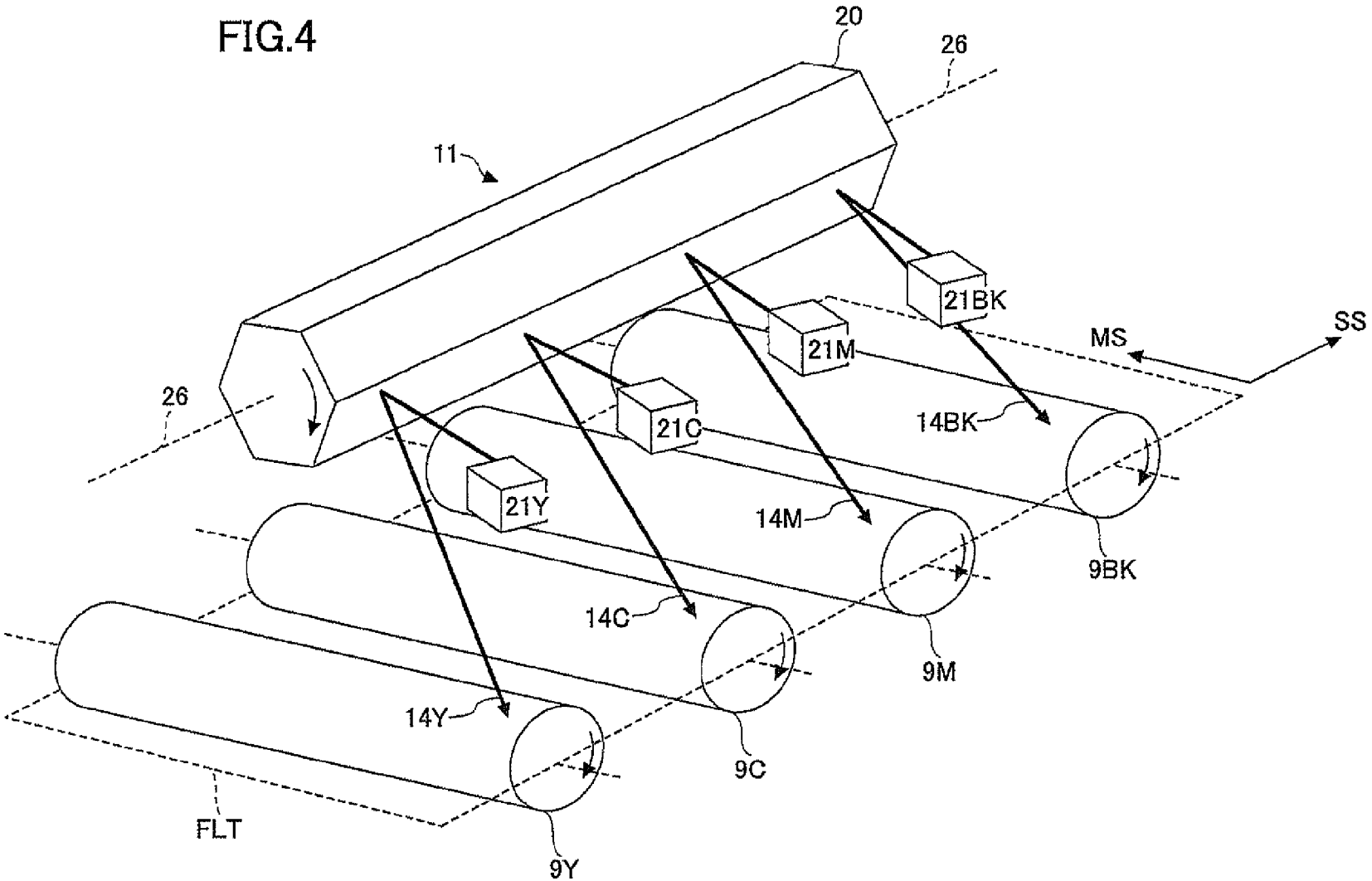
FIG. 4 is a perspective view showing an internal structure of the exposure unit in the first embodiment of the present invention.

Exposure Unit Reducing Intervals of Positional Error Correction:

FIG. 4 is a perspective view showing an internal structure of the exposure unit 11 in this first embodiment of the present invention.

In the exposure unit 11 shown in FIG. 4, a rotary axis 26 of a polygon mirror 20 is arranged at a position separated by a predetermined distance from rotary axes of the photoconductive drums 9BK, 9M, 9C and 9Y which are arranged parallel to each other. Further, the rotary axis 26 of the polygon mirror 20 is arranged perpendicularly to the rotary axes of the photoconductive drums 9BK, 9M, 9C and 9Y. Hence, the rotary axis 26 of the polygon mirror 20 is parallel to the sub scan direction SS, that is, the transport direction of the recording medium 4. In other words, the rotary axis 26 of the polygon mirror 20 is parallel to a plane FLT which passes through each of the rotary axes of the photoconductive drums 9BK, 9M, 9C and 9Y.

Laser beams 14BK, 14M, 14C and 14Y emitted from laser diodes 21BK, 21M, 21C and 21Y are simultaneously reflected by the same reflection surface of the polygon mirror 20, and are directed towards the corresponding photoconductive drums 9BK, SM, 9C and 9Y to irradiate the surfaces of the corresponding photoconductive drums 9BK, 9M, 9C and 9Y.

In the exposure unit 11 shown in FIG. 4, the polygon mirror 20 is arranged so that a rotating direction of the polygon mirror 20 corresponds to the main scan direction MS, that is, the direction in which the laser beam 14 scans the surface of the photoconductive drum 9. As a result, it is unnecessary to deflect the laser beam 14 in the optical path from the polygon mirror 20 to the photoconductive drum 9.

Figure 5:
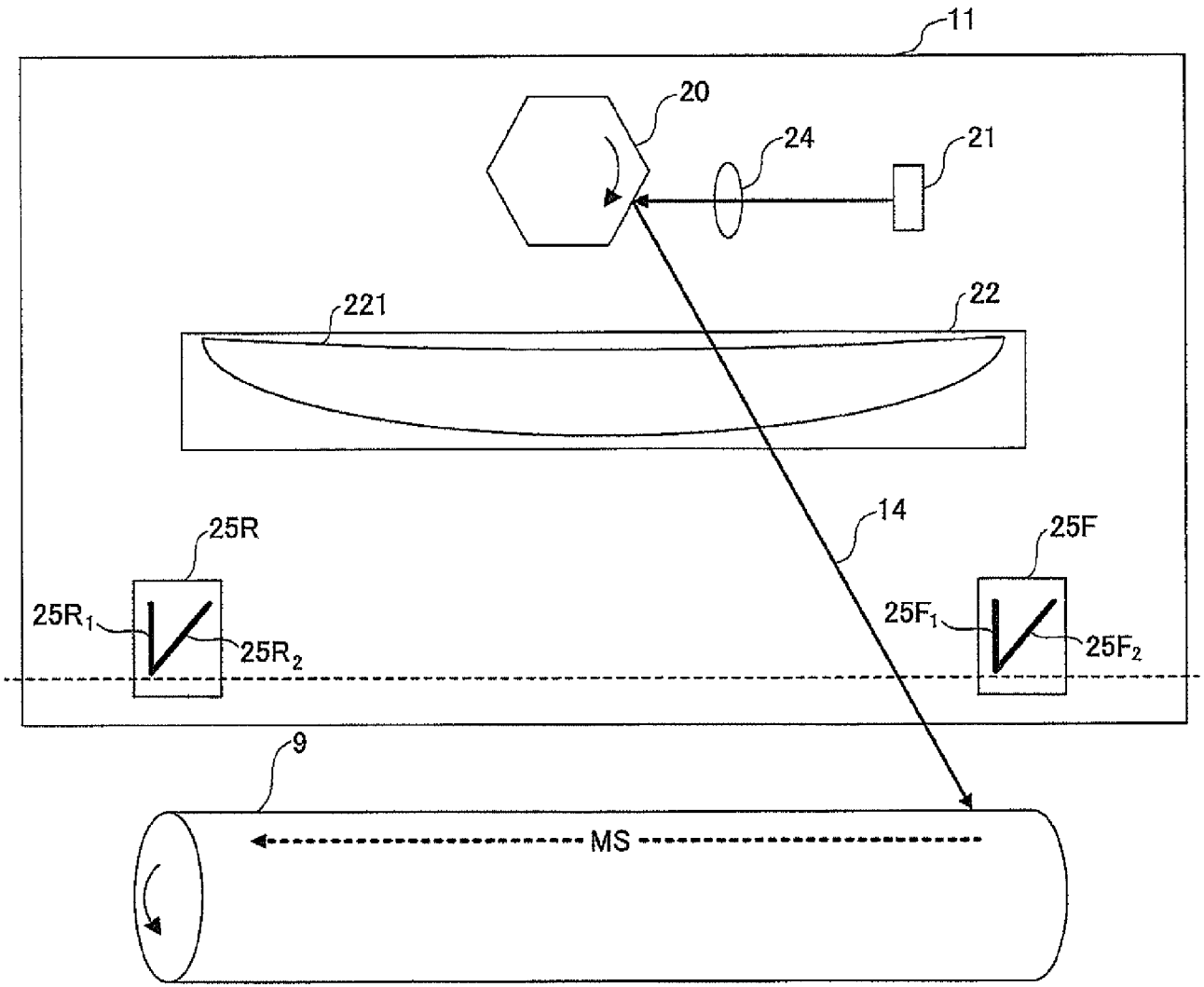
FIG. 5 is a diagram for explaining the exposure unit relative to one photoconductive drum in the first embodiment of the present invention when a polygon mirror is rotationally controlled.

Rotational Control of Polygon Within Exposure Unit:

Next, a description will be given of the rotational control of the polygon 20, which is rotated by a motor (not shown), within the exposure unit 11. FIG. 5 is a diagram for explaining the exposure unit 11 relative to one photoconductive drum 9 in this first embodiment of the present invention when the polygon mirror 20 is rotationally controlled. FIG. 5 shows the exposure unit 11 in relation to a front view of the photoconductive drum 9.

In FIG. 5, the laser beam 14 emitted from the laser diode 21 is transmitted through a lens 24 and reaches the polygon mirror 20. The lens 24 adjusts a spot diameter of the laser beam 14 irradiated on the surface of the photoconductive drum 9. The laser beam 14 reflected by the reflection surface of the polygon mirror 20 passes through an optical system 22, and irradiates the surface of the photoconductive drum 9 to scan in the main scan direction MS. As shown in FIG. 5, the optical system 22 is made up solely from a fθ-lens 221, and does not include a deflection mirror 222. The fθ-lens 221 aligns or corrects the reflected laser beam 14 from the polygon mirror 20 into equally spaced intervals on the surface of the photoconductive drum 9 when the laser beam 14 irradiates the surface of the photoconductive drum 9. In other words, the fθ-lens 221 has the functions of controlling the irradiating period of the laser beam 14 to be constant with respect to the surface of the photoconductive drum 9, and maintaining the spot diameter of the laser beam 14 to be constant on the surface of the photoconductive drum 9.

In order to accurately form the latent image, the laser beam 14 reflected by the reflection surface of the polygon mirror 20 needs to stably scan a predetermined position on the surface of the photoconductive drum 9. Hence, when the exposure unit 11 performs a scan amounting to one reflection surface of the polygon mirror 20 by the laser beam 14, the rotary position of the polygon mirror 20 is detected by a synchronization detection plate 25F which detects a write start position and a synchronization detection plate 25R which detects a write end position. The positions of the synchronization detection plates 25F and 25R are fixed as opposed to the rotary position of the polygon mirror 20 which changes. For this reason, it is possible to control the image height of the latent image formed on the surface of the photoconductive drum 9 when the scan is performed, by determining the write timing of the latent image based on the laser beam detection timings of the synchronization detection plates 25F and 25R. The image forming apparatus 10 corrects the registration error in the main scan direction MS in the above described manner.

The synchronization detection plate 25F includes a first sensor 25F1 which is arranged perpendicularly to the main scan direction MS of the laser beam 14, and a second sensor 25F2 which has a predetermined inclination with respect to the main scan direction MS. Similarly, the synchronization detection plate 25R includes a first sensor 25R1 which is arranged perpendicularly to the main scan direction MS of the laser beam 14, and a second sensor 25R2 which has a predetermined inclination with respect to the main scan direction MS. The timing at which the laser beam 14 passes between the two sensors 25F1 and 25F2 or, between the two sensors 25R1 and 25R2, changes depending on the tilt of the polygon mirror 20 or the fθ-lens 221. By using the exposure unit 11 shown in FIG. 5 and comparing a change in the timings at which the laser beam 14 passes the synchronization detection plates 25F and 25R, it is possible to detect the skew introduced in the latent image caused by the tilt of the polygon mirror 20.

Figure 6:
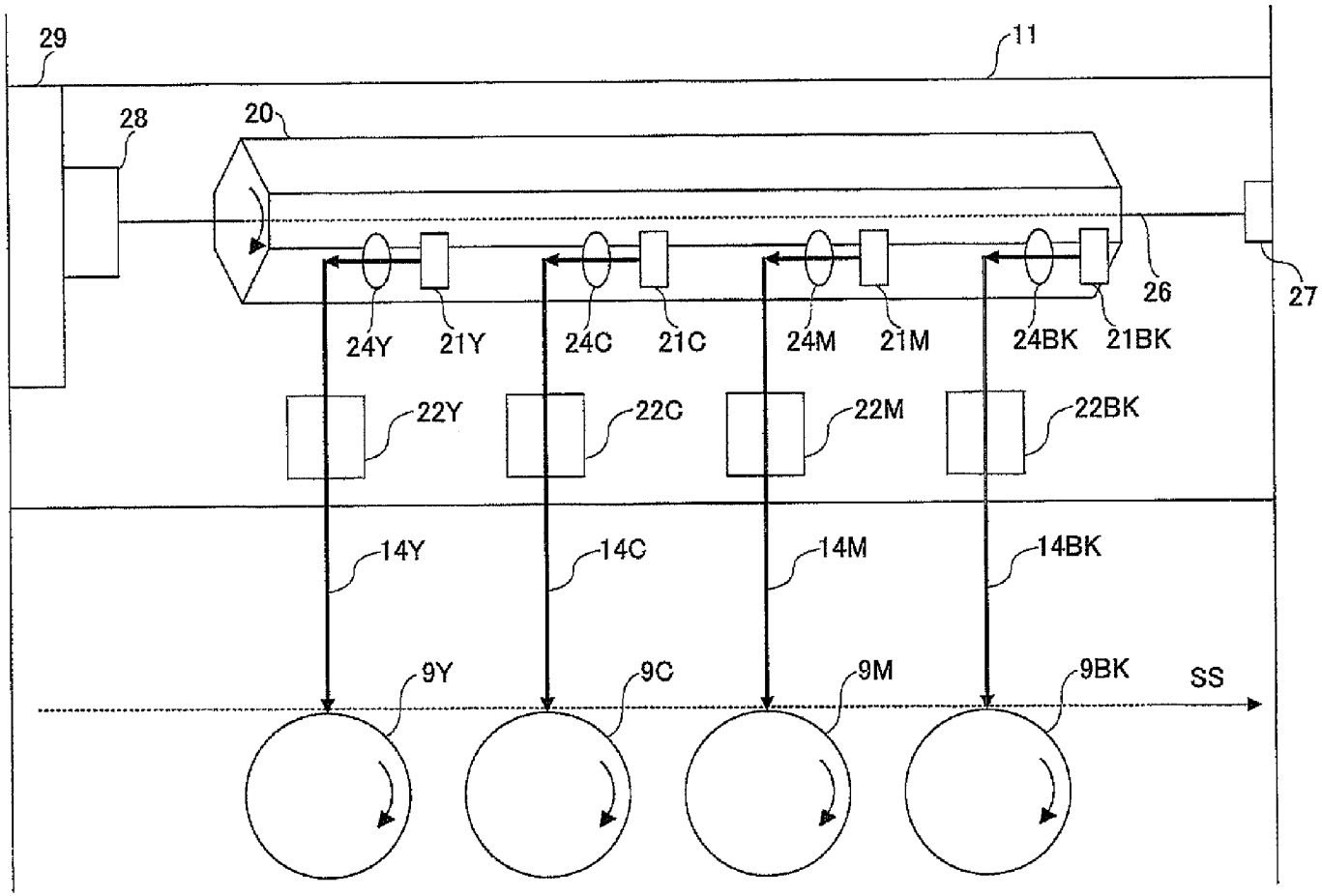
FIG. 6 is a diagram for explaining the exposure unit in the first embodiment of the present invention when the polygon mirror is rotationally controlled.

Next, a description will be given of the rotational control of the polygon 20, which is rotated by a motor (not shown), within the exposure unit 11. FIG. 6 is a diagram for explaining the exposure unit 11 relative to the photoconductive drums 9BK, 9M, 9C and 9Y in this first embodiment of the present invention when the polygon mirror 20 is rotationally controlled. FIG. 6 shows the exposure 11 in relation to a side view of the photoconductive drums 9BK, 9M, 9C and 9Y.

In FIG. 6, the polygon mirror 26 is fixed to a rotary shaft 26. One end of the rotary shaft 26 is connected to a motor 28 which forms a driving unit, and the other end of the rotary shaft 26 is supported by a bearing 27 which is provided on an inner wall of the exposure unit 11. The motor 28 drives the rotary shaft 26 and rotates the polygon mirror 20. An actuator 29 tilts the polygon mirror 20 or the exposure unit 11 itself in response to the detection timings of the synchronization detection plates 25F and 25R, that is, in response to the detected skew, in order to correct the skew and suppress the generation of skew.

Of course, it is possible to optically detect the positional error correction patterns 23*a*, 23*b* and 23*c* which are formed on the transport belt 5 by the corresponding sensors 17*a*, 17*b* and 17*c* and compute the skew or the registration error in the sub scan direction SS from the detection results of the sensors 17*a*, 17*b* and 17*c*.

According to the image forming apparatus 100 of this embodiment, the increase in the amount of positional error with increasing temperature within the exposure unit 11 is prevented by the structure of the exposure unit 11, to thereby reduce the down-time of the image forming apparatus 100 caused by the positional error correction. Consequently, a stable full color image can be formed without deteriorating the performance of the image forming apparatus 100 from the point of view of the user.

Alternate Rotational Control of Polygon Mirror Within Exposure Unit:

The rotary shaft 26 is rotated by the motor 28 in the above described example. However, the polygon mirror 20 may be rotated within the exposure unit 11 using any suitable alternate structures.

For example, both ends of the rotary shaft 26 may be supported by the corresponding bearing 27 provided on the inner walls of the exposure unit 11, and the polygon mirror 20 itself may be made of a magnetic material. In this case, a portion of the polygon mirror 20 may be surrounded by a magnetic force applying part (not shown). The polygon mirror 20 may be rotated by suitably controlling a magnetic force applied from the magnetic force applying part to the polygon mirror 20.

In the case where the rotary shaft 26 of the polygon mirror 20 is not connected to a driving unit, the rotary shaft 26 does not need to be fixed to the polygon mirror 20, the polygon mirror 20 itself may be rotatably provided on the rotary shaft 26. In this case, both ends of the rotary shaft 26 may be fixed to the inner walls of the exposure unit 11.

Operation of Exposure Unit:

Next, a description will be given of the operation of the exposure unit 11 which forms the electrostatic latent image on the surface of the photoconductive drum 9.

Figure 7:
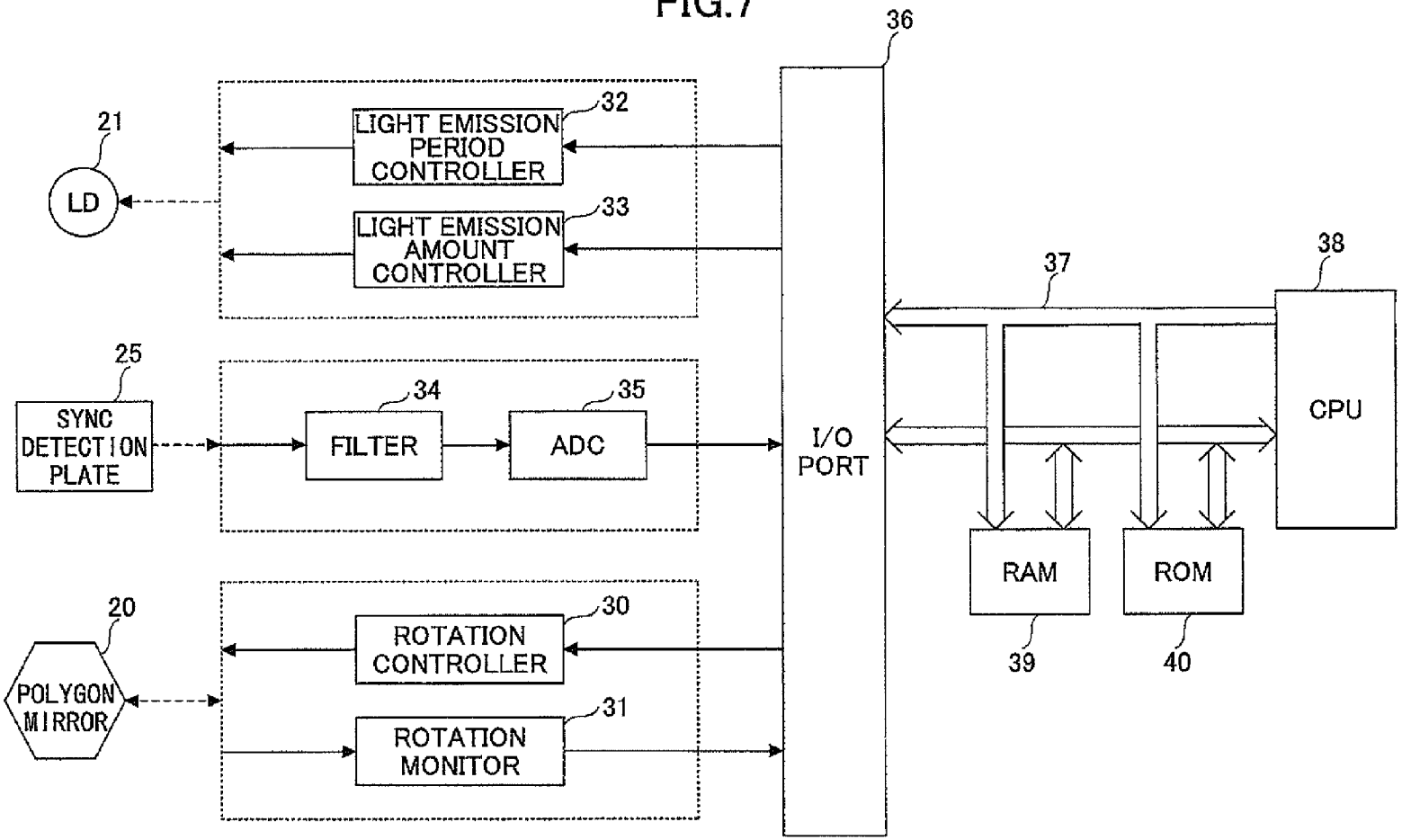
FIG. 7 is a block diagram showing a structure of a control system which controls the exposure unit in the first embodiment of the present invention.

FIG. 7 is a block diagram showing a structure of a control system which controls the exposure unit 11 in this first embodiment of the present invention. The control system shown in FIG. 7 includes an input and output (I/O) port 36, a CPU 38, a random access memory (RAM) 39, and a read only memory (ROM) 40.

The I/O port 36 provides an input and output (I/O) interface for data and control signals exchanged between the control system and each control target part of the image forming apparatus 100 related to the exposure operation. The ROM 40 stores various programs and data, including various control values) for controlling the operation of the control system. The RAM 39 temporarily stores the various programs and data read from the ROM 40, and data including image data. The CPU 38 executes the programs in the RAM 39 and performs computing processes according to the various control values. The CPU 38 controls each control target part of the image forming apparatus 100 related to the exposure operation, by inputting a control signal to each control target part and issuing control instructions.

The I/O port 36, the CPU 38, the RAM 39 and the ROM 40 are connected via a bus 37. Each control target part of the image forming apparatus 100 related to the exposure process, which is the target of the control by the control system, is connected to the I/O port 36. Hence, the control system controls the operations of the control target parts, such as the laser diodes 21BK, 21M, 21C and 21Y, the synchronization detection plates 25F and 25R, and the polygon mirror 20 within the exposure unit 11. In FIG. 7, one of the laser diodes 21Bk, 21M, 21C and 21Y is denoted by a reference numeral 21, the laser beam emitted from the above one of the laser diodes 21BK, 21M, 21C and 21Y is denoted by a reference numeral 14, and the synchronization detection plates 25F and 25R are denoted by a reference numeral 25.

When a rotation controller 30 of the control system receives a rotation start control instruction from the CPU 38 via the I/O port 36, the rotation controller 30 controls the rotation of the polygon mirror 20 by controlling the motor 28, for example. While the polygon mirror 20 rotates, a rotation monitor 31 of the control system monitors the constant rotation of the polygon mirror 20. The rotation monitor 31 outputs an error signal when an abnormality is detected in the rotation of the polygon mirror 20. This error signal is input to the CPU 38 via the I/O port 36.

When the control system confirms the constant rotation of the polygon mirror 20, a light emission period controller 32 of the control system receives a light emission start control instruction from the CPU 38. The light emission period controller 32 controls the laser diode 21 to emit the laser beam 14 until the synchronization detection plates 25 detect the laser beam 14 irradiated on the corresponding photoconductive drum 9. The light intensity of the laser beam 14 is controlled to a level detectable by the synchronization detection plates 25 by a light emission amount controller 33 of the control system.

The synchronization detection plates 25 output signals indicating the laser beam detection timings of the laser beam 14 irradiated on the photoconductive drum 9, and a filter 34 extracts only a detection component of the laser beam 14. The detection component is supplied to an analog-to-digital converter (ADC) 35 which converts the analog data (that is, the detection component) into digital data. The digital data output from the ADC 35, that is, the synchronization detection data, is input to the CPU 38 via the I/O port 36.

When the CPU 38 of the control system receives the synchronization detection data, the CPU 38 outputs a light emission end control instruction which is supplied to the light emission period controller 32 and the light emission amount controller 33 via the I/O port 36, and the laser diode 14 is turned OFF. The CPU 38 also computes an exposure start timing (or image write timing) for accurately forming the latent image on the surface of the photoconductive drum 9, based on the reception timing of the synchronization detection data. In addition, when the CPU 38 receives the error signal from the rotation monitor 31, the CPU 38 stops the rotation control of the polygon mirror 20 and stops the light emission control of the laser diode 21.

Furthermore, the CPU 38 executes a page description language (PDL) interpreting process, for example, to generate image data based on the print data, and temporarily stores the image data in the RAM 39. The image data stored in the RAM 39 are transferred to the CPU 38 when the image write process is started. The CPU 38 starts the image write process according to the image write timing that is computed based on the reception timing of the synchronization detection data.

The CPU 38 also converts the image data into various data, including data indicating the ON-time of the laser diode 21, the ON-level of the laser diode 21, the OFF-time of the laser diode 21 and the like. The various data obtained by this conversion in the CPU 38 are output to the light emission period controller 32 and the light emission amount controller 33 via the I/O port 36. As a result, the light emission of the laser diode 21 within the exposure unit 11 is controlled by the light emission period controller 32 and the light emission amount controller 33 according to the various data obtained by the conversion in the CPU 38. The laser beam 14 emitted from the laser diode 21 is reflected by the polygon mirror 20 that is rotationally controlled by the rotation controller 30 and is irradiated on the surface of the photoconductive drum 9 to expose the surface of the photoconductive drum 9.

The operation of the exposure unit 11 described above is controlled by the CPU 38 which executes a control program which controls the image forming operation and is stored in the ROM 40.

Figure 8:
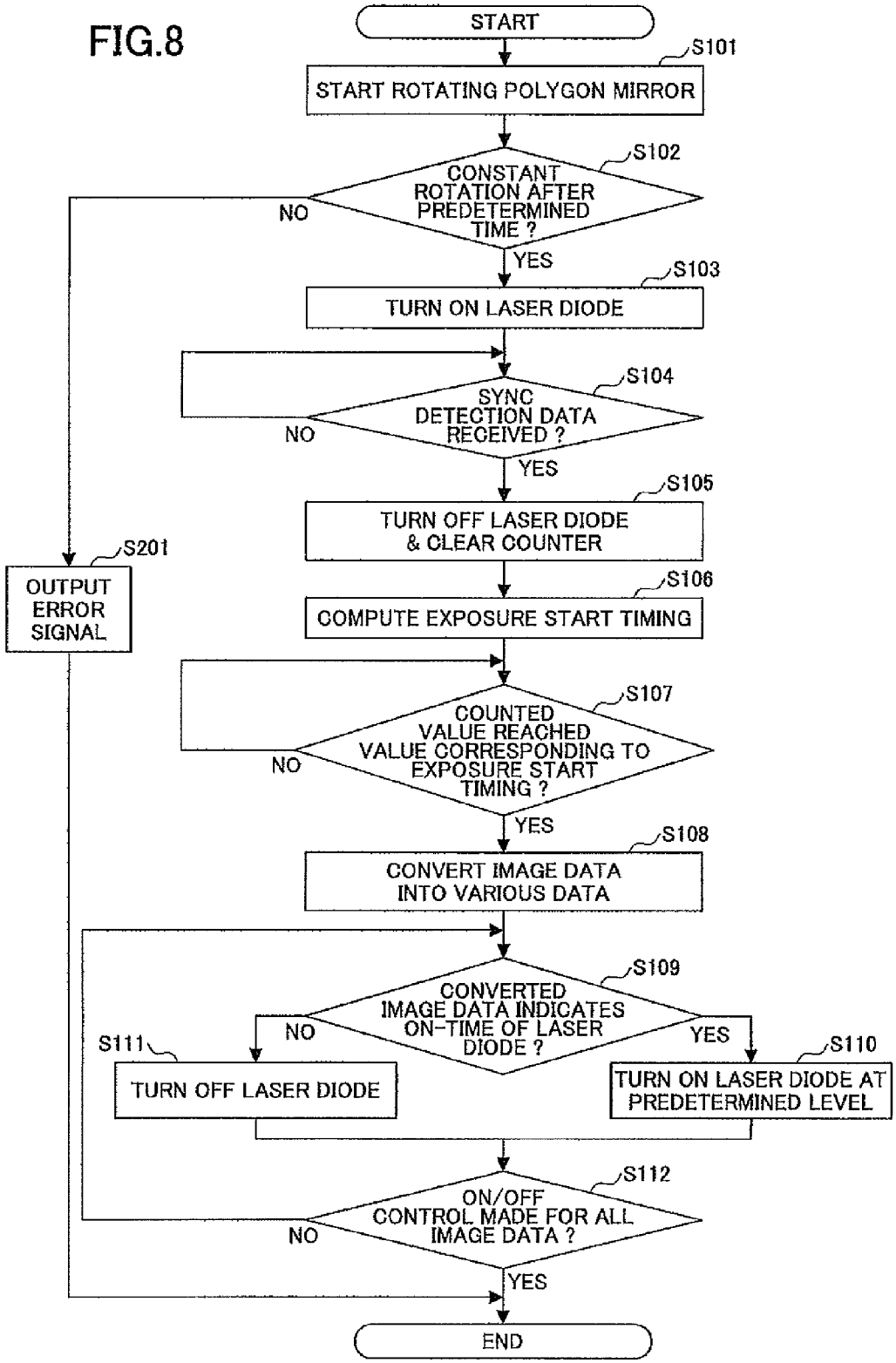
FIG. 8 is a flow chart for explaining a control process when performing an image forming operation in the first embodiment of the present invention.

Details of Control Process:

FIG. 8 is a flow chart for explaining a control process when performing the image forming operation in this first embodiment of the present invention. FIG. 8 shows an example of the control process from the start of rotation of the polygon mirror 20 up to the writing (or exposure) amounting to one line.

In the image forming apparatus 100 of this embodiment, the rotation of the polygon mirror 20 is started by the rotation controller 30 when the CPU 38 outputs the rotation start control instruction to the rotation controller 30 (step S101).

The rotation monitor 31 judges whether the polygon mirror 20 has reached a constant rotation after a predetermined time, which is determined in advance, elapses (step S102). If the polygon mirror 20 has not reached the constant rotation (NO in step S102), the rotation monitor judges that an abnormality is generated in the control system and outputs the error signal to the CPU 38 (step S201), and the control process ends.

On the other hand, if the polygon mirror 20 has reached the constant rotation (YES in step S102), the light emission period controller 32 and the light emission amount controller 33 turn ON the laser diode 21 (step S103). The CPU 38 judges whether the synchronization detection data (or synchronization detection signal) is received from the synchronization detection plates 25 via the filter 34 and the ADC 35 (step S104). If the CPU 38 does not receive the synchronization detection data (NO in step S104), CPU 38 waits for the reception of the synchronization detection data.

If the CPU 38 judges that the synchronization detection data is received (YES in step S104), the CPU 38 outputs an OFF instruction in order to turn OFF the laser diode 21 by the light emission period controller 32 and the light emission amount controller 33 (step S105). In addition, the CPU 38 clears a counter (hereinafter referred to as an image data counter) which controls an image data transfer timing of the image data in the RAM 39, and starts counting up the image data counter (step S105).

The CPU 38 computes the exposure start timing based on the reception timing of the synchronization detection data and stores the exposure start timing in the RAM 39 (step S106). The CPU 38 judges whether the counted value of the image data counter has reached a value corresponding to the exposure start timing stored in the RAM 39 (step S107). If the counted value of the image data counter has not reached the value corresponding to the exposure start timing (NO in step S107), the CPU 38 waits until the counted value of the image data counter reaches the value corresponding to the exposure start timing.

On the other hand, if the counted value of the image data counter has reached the value corresponding to the exposure start timing (YES in step S107), the CPU 38 converts the image data stored in the RAM 39 into the various data, including data indicating the ON-time of the laser diode 21, the ON-level of the laser diode 21, the OFF-time of the laser diode 21 and the like (step S108). The CPU 38 judges whether the converted image data indicates the ON-time of the laser diode 21 (step s109).

If the converted image data indicates the OFF-time of the laser diode 21 (NO in step S109), the CPU 38 outputs the OFF instruction in order to turn OFF the laser diode 21 by the light emission period controller 32 and the light emission amount controller 33 (step S111). On the other hand, if the converted image data indicates the ON-time of the laser diode 21 (YES in step S109), the CPU 38 outputs an ON instruction in order to turn ON the laser diode 21 at a predetermined level by the light emission period controller 32 and the light emission amount controller 33 (step S110).

Next, the CPU 38 judges whether the ON/OFF control of the laser diode 21 has been made with respect to all of the image data (step S112). If the ON/OFF control of the laser diode 21 has not been made with respect to all of the image data (NO in step S112), the process returns to the step S109 in order to perform the control process until the ON/OFF control of the laser diode 21 is made with respect to all of the image data. On the other hand, if the ON/OFF control of the laser diode 21 has been made with respect to all of the image data (YES in step S112), the control process ends.

Therefore, the operation of the exposure unit 11 is controlled in the above described manner by the control process, and the image forming function is realized in the image forming apparatus 100 of this embodiment.

According to this embodiment, the rotary axis 26 of the polygon mirror 20 is separated from the rotary axes of the photoconductive drums 9BK, 9M, 9C and 9Y by identical distances along respective normals which are perpendicular to both the rotary axis 26 of the polygon mirror 20 and a corresponding one of the plurality of rotary axes of the photoconductive drums 9BK, 9M, 9C and 9Y. The rotary axes of the photoconductive drums 9BK, 9M, 9C and 9Y are arranged parallel to each other. By using this arrangement, each laser beam 14 reflected by the polygon mirror 20 can be irradiated on the surface of the corresponding photoconductive drum 9 without being intermediated by a deflection mirror 222. For this reason, it is possible to prevent the amount of positional error from increasing with increasing temperature within the exposure unit 11, which would otherwise be caused by a change in the inclination of the deflection mirror 222. As a result, it is unnecessary to frequently perform the positional error correction with respect to the exposure unit 11 of the image forming apparatus 100, and the down-time of the image forming apparatus 100 caused by the positional error correction can be reduced. Consequently, it is possible to form a stable full color image without deteriorating the performance of the image forming apparatus 100 from the point of view of the user.

[First Modification of First Embodiment]

Figure 9:
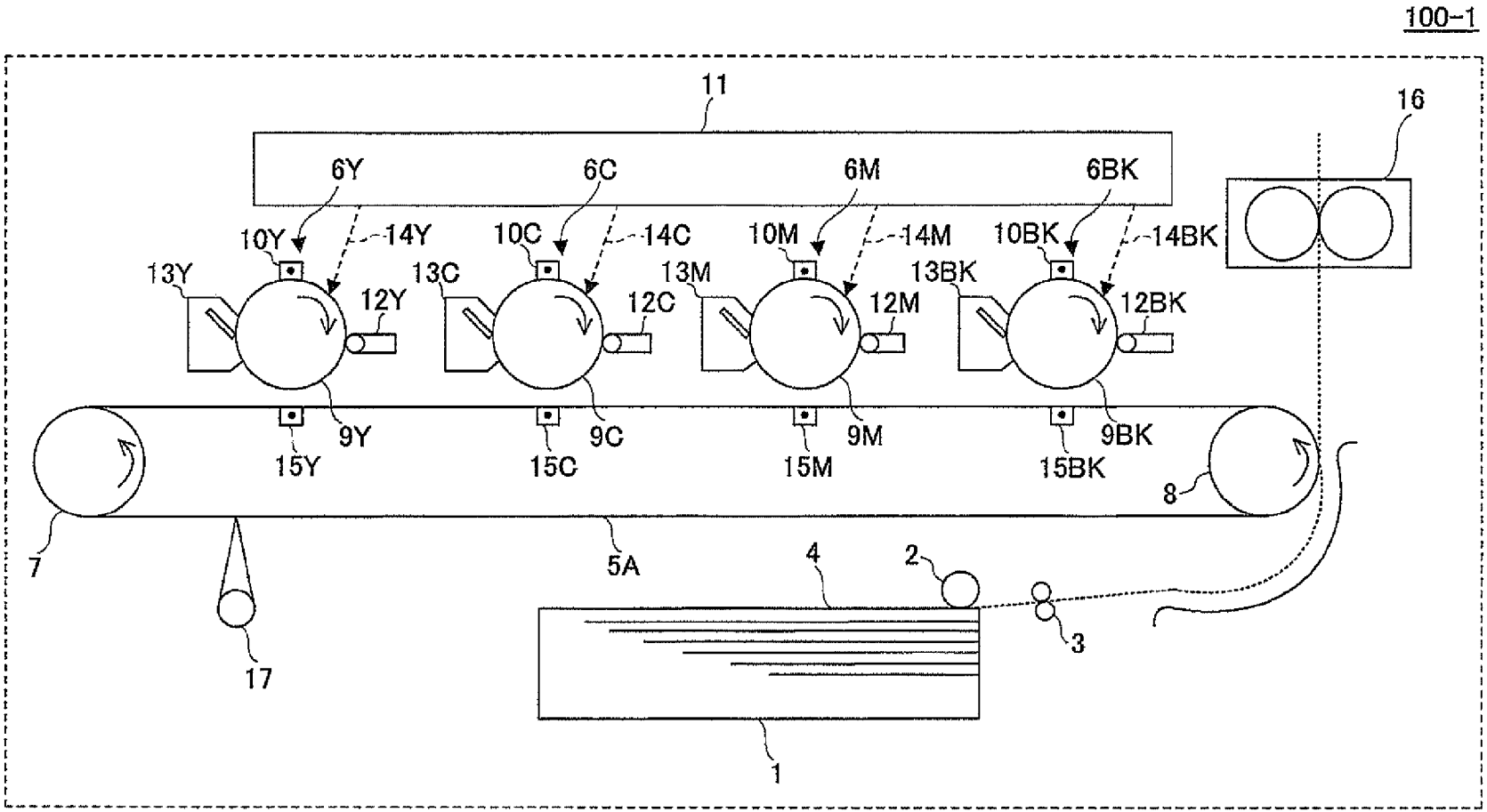
FIG. 9 is a diagram showing an example of a hardware structure of an image forming apparatus which performs an image formation by intermediate transfer.

Next, a description will be given of a first modification of the first embodiment of the present invention, by referring to FIG. 9. FIG. 9 is a diagram showing an example of a hardware structure of an image forming apparatus which performs an image formation by intermediate transfer. In FIG. 9, those parts that are the same as those corresponding parts in FIG. 1 are designated by the same reference numerals, and a description thereof will be omitted.

An image forming apparatus 100-1 shown in FIG. 9 employs an intermediate transfer. According to the intermediate transfer, the toner images are successively formed in an overlapping manner on a transport belt 5A and the full color toner image on the transport belt 5A is transferred onto the recording medium 4. Otherwise, the image forming operation is similar to that of the image forming apparatus 100 shown in FIG. 1. The effects obtainable by the use of the exposure unit 11 are also obtainable in this first modification.

[Second Modification of First Embodiment]

Figure 10:
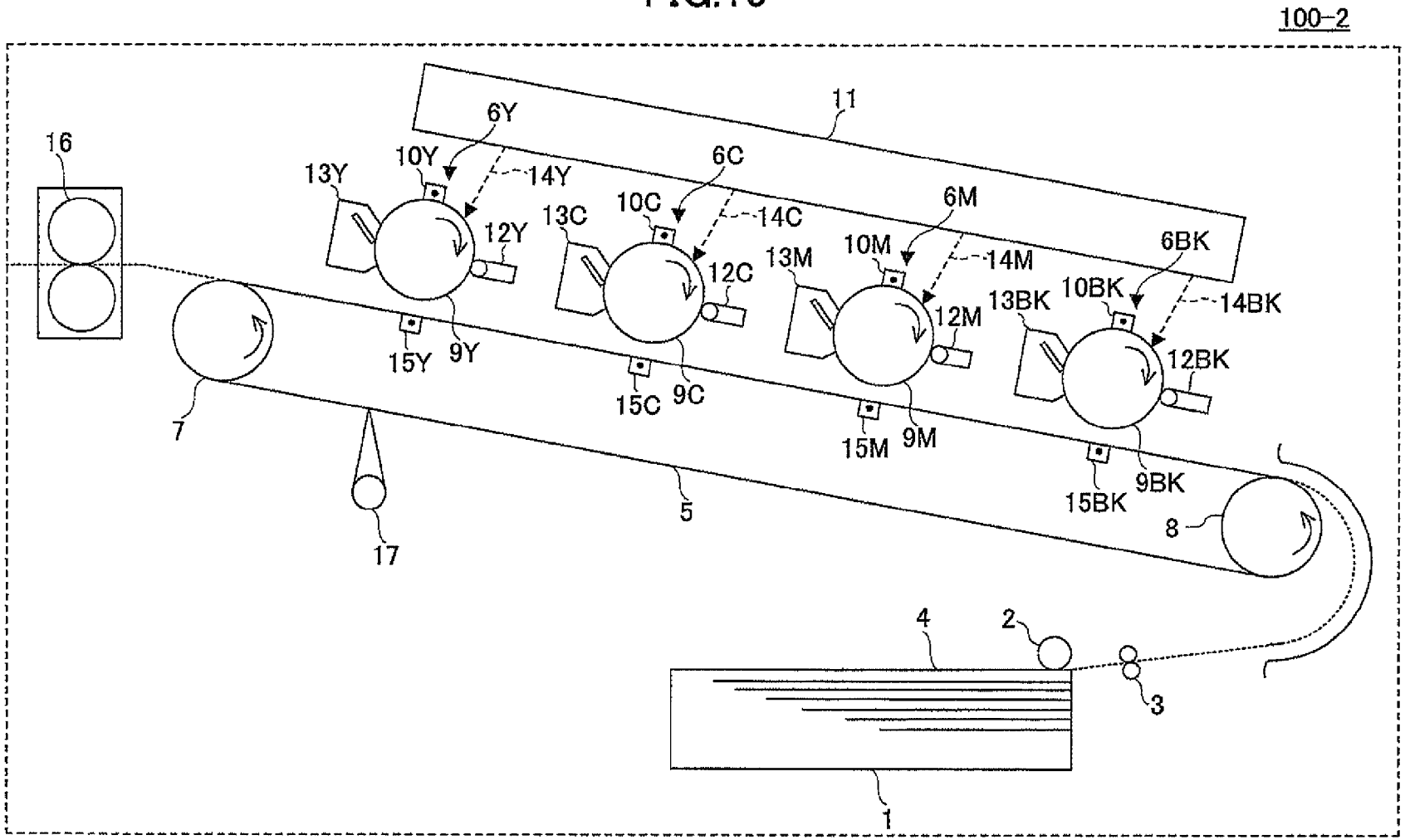
FIG. 10 is a diagram showing another example of the hardware structure of the image forming apparatus employing the tandem system in the first embodiment of the present invention.

Next, a description will be given of a second modification of the first embodiment of the present invention, by referring to FIG. 10. FIG. 10 is a diagram showing another example of the hardware structure of the image forming apparatus employing the tandem system in the first embodiment of the present invention. In FIG. 10, those parts that are the same as those corresponding parts in FIG. I are designated by the same reference numerals, and a description thereof will be omitted.

Unlike the image forming apparatus shown in FIG. 1 wherein the image forming unit 6, the exposure unit 11 and the transport belt 5 are arranged parallel to a setup surface, such as the floor, on which the image forming apparatus 100 is set up, an image forming apparatus 100-2 shown in FIG. 10 has an image forming unit 6, an exposure unit 11 and a transport belt 5 which are arranged with an inclination relative to the setup surface, such as the floor. For example, the image forming unit 6, the exposure unit 11 and the transport belt 5 may be arranged diagonally with respect to the side surface of the image forming apparatus 100-2.

[Second Embodiment]

In the exposure unit 11 of the first embodiment, the optical system 22 is made up solely from the fθ-lens 221. However, the characteristic of the fθ-lens 221 may vary among the individual fθ-lenses 221, and a change in the characteristic of the fθ-lens 221 caused by a temperature rise within the exposure unit 11 may generate a color registration error or a magnification (or zoom) error in the main scan direction MS. The amount of positional error in the main scan direction MS may change with lapse of time (or aging), similarly to the amount of positional error in the sub scan direction SS.

Next, a description will be given of the exposure unit 11 in a second embodiment of the present invention, which does not use a deflection mirror 222 nor a fθ-lens 221, that is, does not have an optical system 22, by referring to FIG. 11. The basic structure of the image forming apparatus 100 in this second embodiment is the same as that of the first embodiment shown in FIG. 1. Accordingly, a description will be given only with respect to the structure of the exposure unit 11 which differs from that of the first embodiment.

Figure 11:
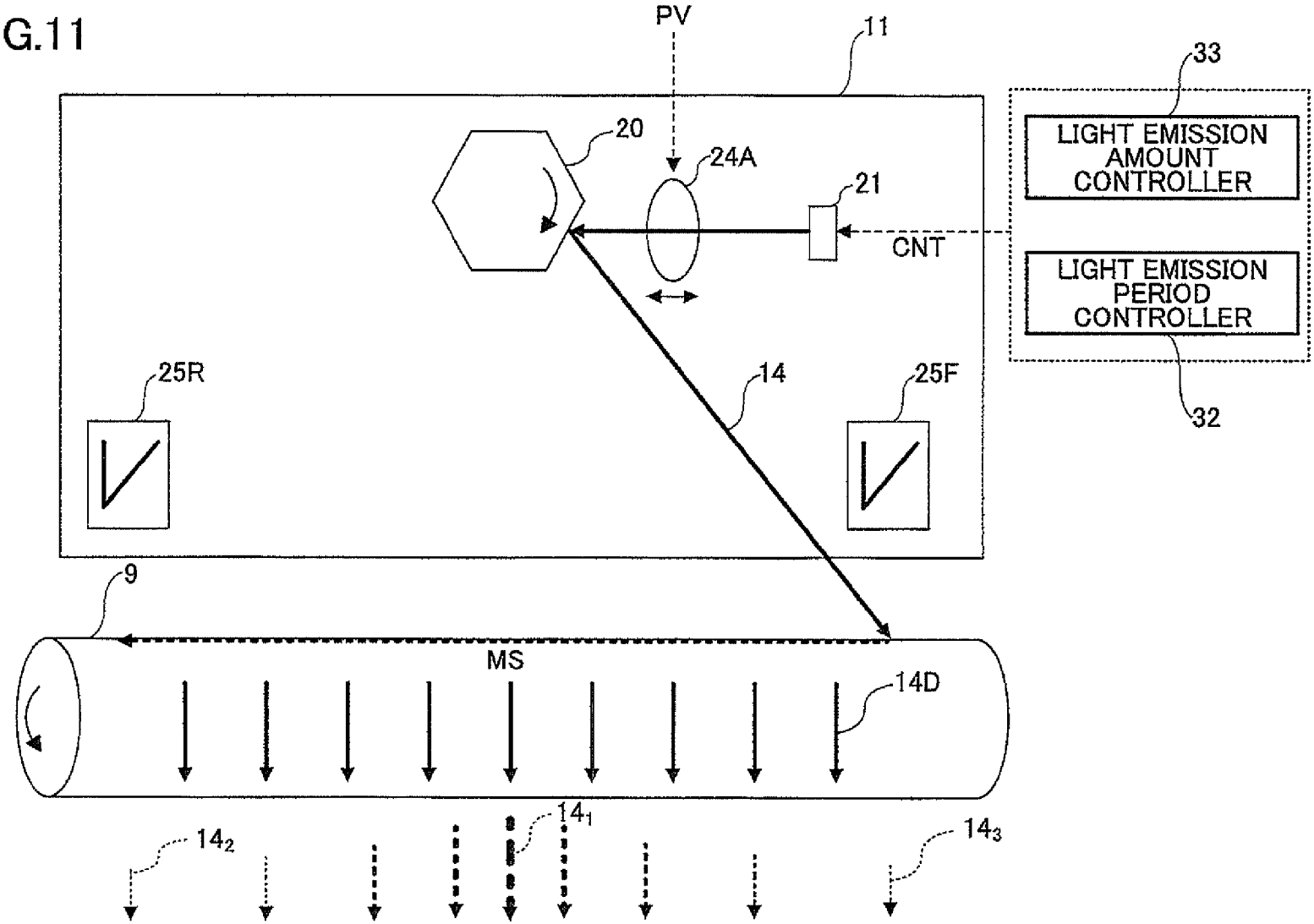
FIG. 11 is a diagram showing a structure of the exposure unit in a second embodiment of the present invention relative to one photoconductive drum.

Structure of Exposure Unit:

FIG. 11 is a diagram showing the structure of the exposure unit 11 in this second embodiment of the present invention relative to one photoconductive drum 9. FIG. 11 shows the exposure unit 11 in relation to a front view of the photoconductive drum 9. In FIG. 11, those parts that are the same as those corresponding parts in FIGS. 5 and 7 are designated by the same reference numerals, and a description thereof will be omitted.

As may be seen from a comparison of FIGS. 11 and 5, the exposure unit 11 of this second embodiment does not have the optical system 22 including the fθ-lens 221. Because no fθ-lens 221 is provided, the laser beam 14 reflected by the polygon mirror 20 and irradiated on the surface of the photoconductive drum 9 has a different light intensity depending on the irradiating position on the surface of the photoconductive drum 9. For example, a laser beam $\mathbf{14}_1$ indicated by a bold phantom arrow, which is irradiated approximately at the center along the axial direction (or longitudinal direction) of the photoconductive drum 9 has a relatively small spot diameter and a relatively high light intensity. On the other hand, a laser beam $\mathbf{14}_2$ indicated by a thin phantom arrow, which is irradiated on both ends along the axial direction of the photoconductive drum 9 has a relatively large spot diameter and a relatively low light intensity. In FIG. 11, the length of the phantom arrow indicating the laser beam 14, illustrated below the photoconductive drum 9 for the sake of convenience, corresponds to the light intensity, such that the longer the arrow the higher the light intensity.

When the writing or exposure of the image data on the surface of the photoconductive drum 9 is made in the above described state where the light intensity of the laser beam 14 differs depending on the irradiating position of the laser beam 14, the spot diameter and the received light intensity do not become constant on the surface of the photoconductive drum 9. As a result, a distortion or tone inconsistency may occur in the image that is formed on the recording medium 4 by the image forming apparatus 100. In this case, the quality of the image that is formed deteriorates, and it is difficult to form a stable full color image.

Hence, in the exposure unit 11 of this second embodiment, the spot diameter and the received light intensity on the surface of the photoconductive drum 9 are controlled to be constant in order to prevent the distortion or tone inconsistency in the image that is formed on the recording medium 4.

Control of Beam Spot Diameter:

In this second embodiment, the exposure unit 11 is provided with a lens 24A which is arranged in an optical path between the laser diode 21 and the polygon mirror 20 and has a focal distance that is adjustable by electrically varying the thickness of the lens 24A. The lens 24A is formed by a transparent conductive liquid which is provided in the form of a water drop on a transparent substrate, and has a diameter on the order of several μm to several mm. The transparent substrate is water repellent or, is coated with a water repellent agent which forms a water repellent film. Both the transparent conductive liquid and the transparent substrate are transparent with respect to the wavelength of the laser beam 14. The laser beam 14 which is transmitted through the lens 24A is focused at a focal point which is a predetermined distance from a contact surface where the transparent conductive liquid and the transparent substrate contact each other.

The focal distance of the lens 24A is adjusted by applying a predetermined voltage across the transparent conductive liquid and a transparent electrode which is provided on the transparent substrate. By applying the predetermined voltage across the transparent conductive liquid and the transparent electrode, a contact region where the transparent conductive liquid makes contact with the transparent substrate spreads and is deformed due to electro wetting. This spreading or deformation of the contact region where the transparent conductive liquid makes contact with the transparent substrate varies the thickness of the lens 24A to thereby adjust the focal distance of the lens 24A.

According to the exposure unit 11 of this second embodiment, electrical energy can be transformed directly into the change in the shape of the lens 24A. For this reason, it is possible to adjust the focal point of the laser beam 14 without having to mechanically move the lens 24A, that is, without having to change the position of the lens 24A itself.

Hence, in the image forming apparatus 100 of this second embodiment, the control system controls the spot diameter of a laser beam 14D to be constant on the surface of the photoconductive drum 9, depending on the image height of the latent image formed on the surface of the photoconductive drum 9, that is, depending on the irradiating position of the laser beam 14 on the surface of the photoconductive drum 9. More particularly, the voltage applied across the transparent conductive liquid and the transparent electrode is controlled so that the thickness of the lens 24A increases when the laser beam 14D irradiates the surface of the photoconductive drum 9 in a vicinity of the center along the axial direction of the photoconductive drum 9, and the thickness of the lens 24A decreases when the laser beam 14D irradiates the surface of the photoconductive drum 9 in a vicinity of both ends along the axial direction of the photoconductive drum 9.

Control of Light Reception Intervals:

The fθ-lens 221 used in the first embodiment has the function of controlling the spot diameter of the laser beam 14 to be constant by correcting or aligning the reflected laser beam from the polygon mirror 20 into equally spaced intervals on the surface of the photoconductive drum 9.

On the other hand, in the image forming apparatus 100 of this second embodiment, the light emission period controller 32 within the control system controls the light reception intervals (or timings) of the laser beam 14D on the surface of the photoconductive drum 9 depending on the image height of the latent image formed on the surface of the photoconductive drum 9. The light emission period controller 32 controls the laser diode 21 to emit the laser beam 14D until the synchronization detection plates 25 detect the laser beam 14D irradiated on the corresponding photoconductive drum 91 to thereby adjust the light emission period of the laser diode 21 (or the ON period of the laser beam 14D). More particularly, the light emission period of the laser diode 21 is controlled to be longer when the laser beam 14D irradiates the surface of the photoconductive drum 9 in the vicinity of the center along the axial direction of the photoconductive drum 9, and to be shorter when the laser beam 14D irradiates the surface of the photoconductive drum 9 in the vicinity of both ends along the axial direction of the photoconductive drum 9.

Control of Light Reception Intensity:

The light emission amount controller 33 within the control system controls the intensity of the laser beam 14D emitted from the laser diode 21 so that the light reception intensity of the laser beam 14D on the surface of the photoconductive drum 9 is controlled to a constant level, depending on the image height of the latent image formed on the surface of the photoconductive drum 9. More particularly, the light emission amount of the laser diode 21, that is, the intensity of the laser beam 14D that is emitted from the laser diode 21, is controlled to be lower in the vicinity of the center along the axial direction of the photoconductive drum 9, and to be higher in the vicinity of both ends along the axial direction of the photoconductive drum 9.

Operation of Exposure Unit:

The control process performed by the control system which controls the exposure unit 11 is basically the same as that performed in the first embodiment and described above with reference to FIGS. 7 and 8. The control process performed in this second embodiment differs from that of the first embodiment in that this second embodiment controls the spot diameter, the light reception intervals and the light reception intensity to become constant.

Next, a description will be given of a timing at which the control process is performed in this second embodiment. As described above in conjunction with FIG. 8, the CPU 38 of the image forming apparatus 100 in this second embodiment judges whether the converted image data indicates the ON-time of the laser diode 21 (step S109). If the converted image data indicates the ON-time of the laser diode 21 (YES in step S109), the CPU 38 outputs an ON instruction in order to turn ON the laser diode 21 by the light emission period controller 32 and the light emission amount controller 33 (step S110). In this state, the CPU 38 of the image forming apparatus 100 in this second embodiment outputs a control signal to each of the lens 24A, the light emission period controller 32 and the light emission amount controller 33 in order to control the spot diameter, the light reception intervals and the light reception intensity of the laser beam 14D on the surface of the photoconductive drum 9 to become constant.

According to this second embodiment, the rotary axis 26 of the polygon mirror 20 is separated from the rotary axes of the photoconductive drums 9BK, 9M, 9C and 9Y by identical distances along respective normals which are perpendicular to both the rotary axis 26 of the polygon mirror 20 and a corresponding one of the plurality of rotary axes of the photoconductive drums 9BK, 9M, 9C and 9Y. The rotary axes of the photoconductive drums 9BK, 9M, 9C and 9Y are arranged parallel to each other. By using this arrangement, each laser beam 14D reflected by the polygon mirror 20 can be irradiated on the surface of the corresponding photoconductive drum 9 without being intermediated by an optical system 22 which includes a deflection mirror 222 and a fθ-lens 221. For this reason, it is possible to prevent the amount of positional error from increasing with increasing temperature within the exposure unit 11, which would otherwise be caused by a change in the inclination of the deflection mirror 222 and/or a change in the characteristic of the fθ-lens 221. As a result, it is unnecessary to frequently perform the positional error correction with respect to the exposure unit 11 of the image forming apparatus 100, and the down-time of the image forming apparatus 100 caused by the positional error correction can be reduced. Consequently, it is possible to form a stable full color image without deteriorating the performance of the image forming apparatus 100 from the point of view of the user.

Of course, the spot diameter, the light reception intervals and the light reception intensity of the laser beam 14D on the surface of the photoconductive drum 9 may be controlled to become constant in the first embodiment where the optical system 22 including the fθ-lens 221 is provided. In this case, this control will compensate for the characteristic of the fθ-lens 221 and further correct the registration error and the magnification error in the main scan direction MS.

[Third Embodiment]

According to the exposure unit 11 of the first and second embodiments described above, the laser beams 14BK, 14M, 14C and 14Y are reflected by the single polygon mirror 20 and irradiated on the corresponding photoconductive drums 9BK, 9M, 9C and 9Y. On the other hand, in a third embodiment of the present invention, the exposure unit 11 is provided with separate polygon mirrors 20BK, 20M, 20C and 20Y which reflect the corresponding laser beams 14BK, 14M, 14C and 14Y to irradiate the corresponding photoconductive drums 9BK, 9M, 9C and 9Y.

Figure 12:
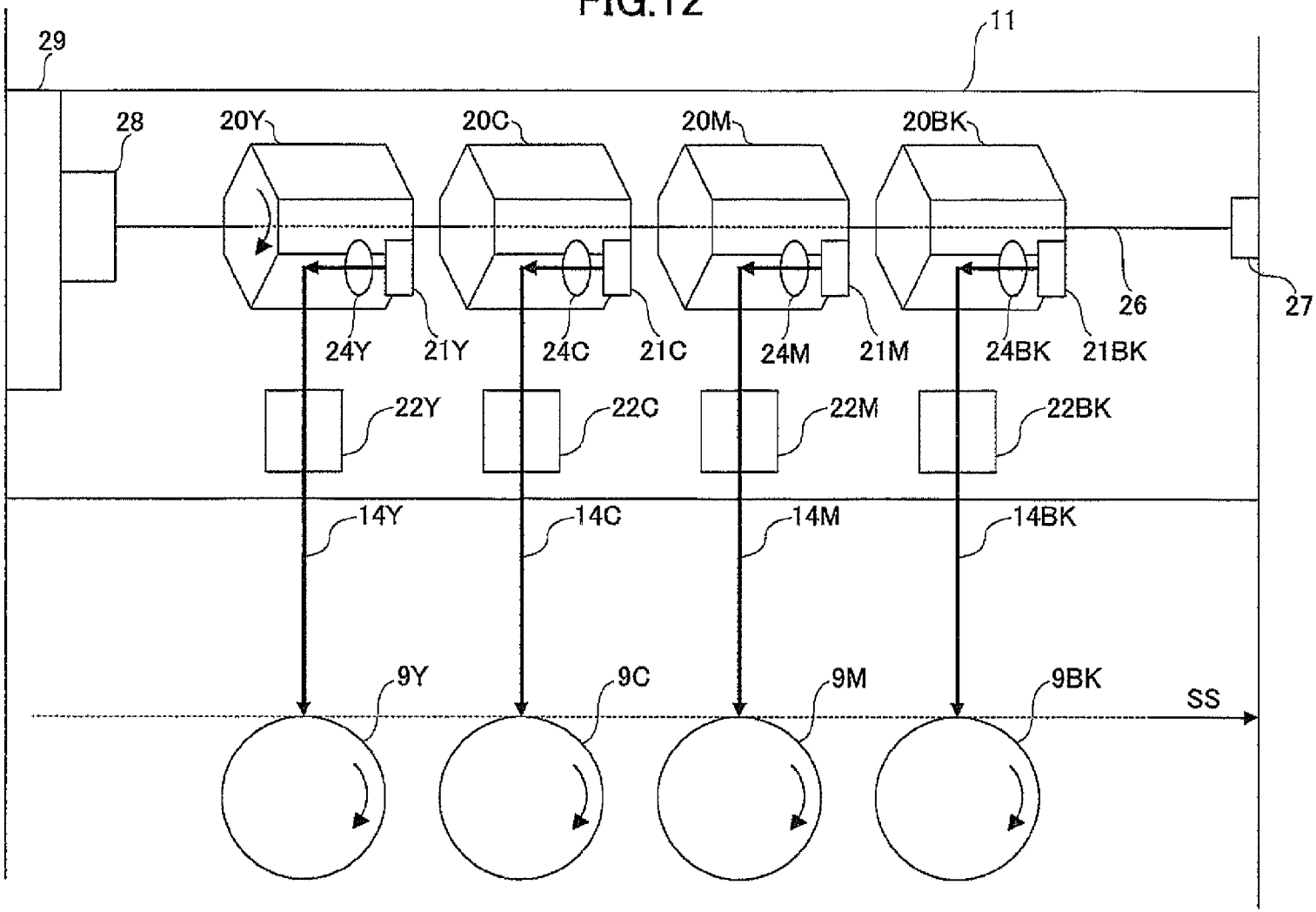
FIG. 12 is a diagram showing a structure of the exposure unit having separate polygon mirrors for mutually different colors in a third embodiment of the present invention.

Structure of Exposure Unit:

FIG. 12 is a diagram showing a structure of the exposure unit 11 having the separate polygon mirrors 20BK, 20M, 20C and 20Y for mutually different colors in this third embodiment of the present invention. FIG. 12 shows the exposure 11 in relation to a side view of the photoconductive drums 9BK, 9M, 9C and 9Y. In FIG. 12, those parts that are the same as those corresponding parts in FIG. 6 are designated by the same reference numerals, and a description thereof will be omitted.

Because the laser beams 14BK, 14M, 14C and 14Y are reflected by the separate polygon mirrors 20BK, 20M, 20C and 20Y which are provided on a common rotary axis, it is possible to reduce the total volume occupied by the polygon mirrors 20BK, 20M, 20C and 20Y when compared to the volume occupied by the single polygon mirror 20 of the first or second embodiment.

On the other hand, the reflecting positions of the laser beams 14BK, 14M, 14C and 14Y on the mirror surfaces of the separate polygon mirrors 20BK, 20M, 20C and 20Y may not match, and the registration error in the main scan direction MS is more likely to occur when compared to the first or second embodiment using the single polygon mirror 20. Hence, it is desirable to align the mirror surfaces of the separate polygon mirrors 20BK, 20M, 20C and 20Y and synchronize the rotation of the polygon mirrors 20BK, 20M, 20C and 20Y.

First Modification of Third Embodiment:

According to the third embodiment, the rotary shaft 26 between two mutually adjacent polygon mirrors, such as the polygon mirrors 20BK and 20M, for example, is exposed. In other words, a gap is formed between two mutually adjacent polygon mirrors. When the gap is formed between two mutually adjacent polygon mirrors, the center of gravity may not be stable when the polygon mirrors 20BK, 20M, 20C and 20Y rotate, and the rotations of the polygon mirrors 20BK, 20M, 20C and 20Y may become inconsistent. Thus, in a first modification of this third embodiment of the present invention, the exposure of the rotary shaft 26 is suppressed, that is, the gap between two mutually adjacent polygon mirrors is eliminated within the exposure unit 11 in order to stabilize the rotations of the polygon mirrors 20BK, 20M, 20C and 20Y.

Figure 13:
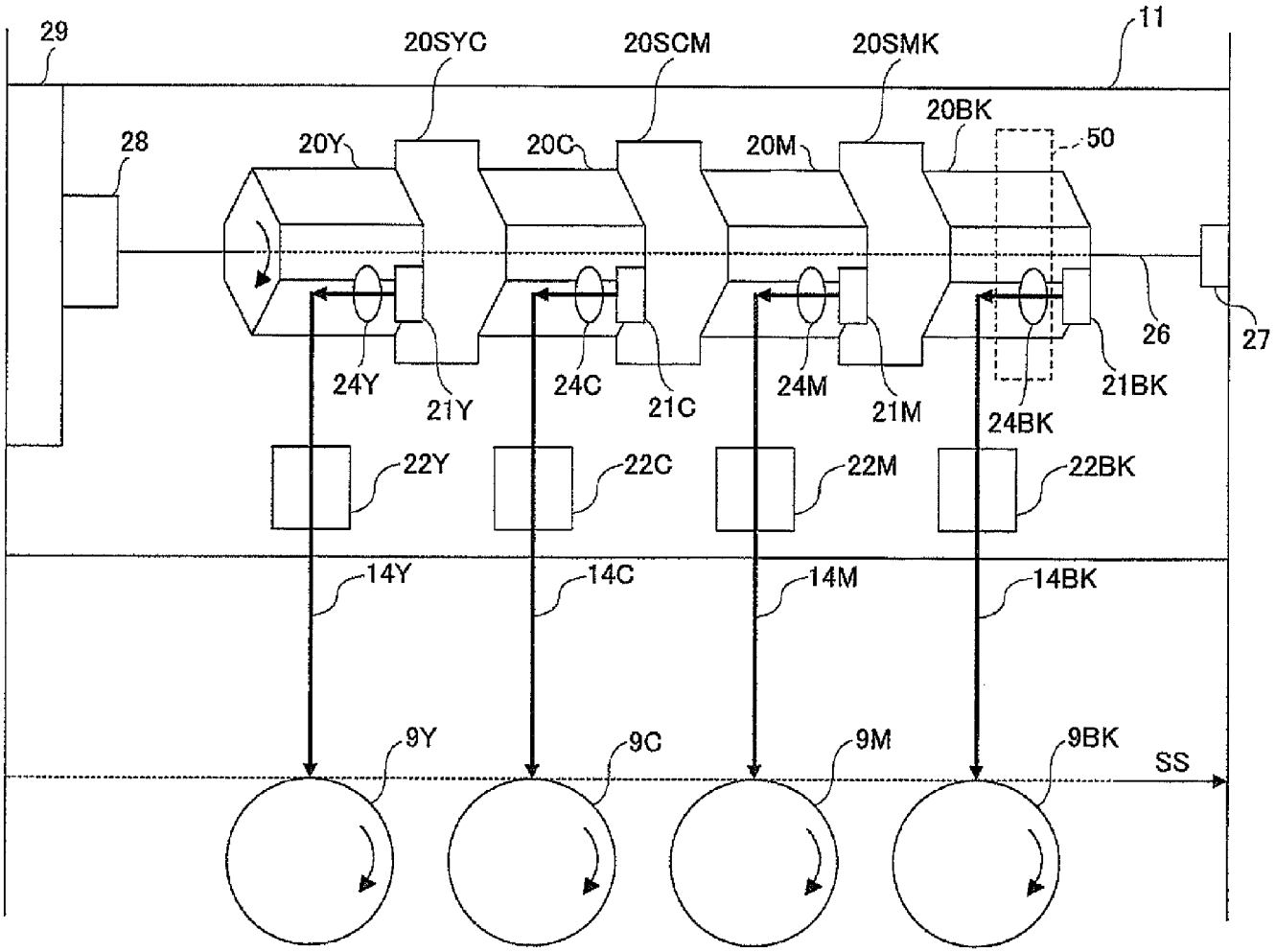
FIG. 13 is a diagram showing a structure of the exposure unit in a first modification of the third embodiment of the present invention.

Structure of Exposure Unit:

FIG. 13 is a diagram showing a structure of the exposure unit in this first modification of the third embodiment of the present invention. FIG. 13 shows the exposure 11 in relation to a side view of the photoconductive drums 9BK, 9M, 9C and 9Y. In FIG. 13, those parts that are the same as those corresponding parts in FIG. 12 are designated by the same reference numerals, and a description thereof will be omitted.

As shown in FIG. 13, a covering member 20SMK is provided between the polygon mirrors 20BK and 20M to cover the rotary shaft 26 and eliminate the gap between the polygon mirrors 20BK and 20M. A covering member 20SCM is provided between the polygon mirrors 20M and 20C to cover the rotary shaft 26 and eliminate the gap between the polygon mirrors 20M and 20C. A covering member 20SYC is provided between the polygon mirrors 20C and 20Y to cover the rotary shaft 26 and eliminate the gap between the polygon mirrors 20C and 20Y. In other words, the polygon mirrors 20BK, 20M, 20C and 20Y are connected into one piece.

Because the covering members 20SMK, 20SCM and 20SYC cover the exposed portions of the rotary shaft 26 between the adjacent polygon mirrors and eliminate the gap between the adjacent polygon mirrors, it is possible to stability the rotations of the polygon mirrors 20BK, 20M, 20C and 20Y. Further, because the polygon mirrors 20BK, 20M, 20C and 20Y are connected into one piece by the covering members 20SMK, 20SCM and 20SYC, it is possible to align the mirror surfaces of the separate polygon mirrors 20BK, 20M, 20C and 20Y and synchronize the rotation of the polygon mirrors 20BK, 20M, 20C and 20Y.

In this first modification of the third embodiment, the rotary shaft 26 is rotated by the motor 28, in order to unitarily rotate the polygon mirrors 20BK, 20M, 20C and 20Y which are connected into one piece by the covering members 20SMK, 20SCM and 20SYC. However, the polygon mirrors 20BK, 20M, 20C and 20Y may be rotated by other mechanisms or means, as described hereunder.

Second Modification of Third Embodiment:

In this second modification of the third embodiment, the motor 28 shown in FIG. 13 is replaced by another bearing 27, and a magnetic force applying part 50 indicated by a dotted line in FIG. 13 is provided in place of the motor 28 as a driving unit. The magnetic force applying part 50 has an approximate ring shape surrounding at least one of the polygon mirrors 20BK, 20M, 20C and 20Y. In addition, at least one of the polygon mirrors 20BK, 20M, 20C and 20Y surrounded by the magnetic force applying part 50 is made of a magnetic material. When the rotation controller 30 of the control system shown in FIG. 7 receives a rotation start control instruction from the CPU 38 via the I/O port 36, the rotation controller 30 controls the rotation of the polygon mirror 20 by controlling a magnetic force to be generated from the magnetic force applying part 50. The magnetic force generated from the magnetic force applying part 50 is applied to the magnetic polygon mirror 20BK to unitarily rotate the polygon mirrors 20BK, 20M, 20C and 20Y.

Alternatively, the magnetic force applying part 50 may surround at least one of the covering members 20SMK, 20SCM and 20SYC, and in this case, at least one of the covering members 20SMK, 20SCM and 20SYC surrounded by the magnetic force applying part 50 is made of a magnetic material. Furthermore, the magnetic force applying part 50 may surround at least one polygon mirror and at least one covering member.

Of course, the magnetic force applying part 50 must be arranged so as not to interfere with the rotation of the polygon mirrors 20BK, 20M, 20C and 20Y and not to intercept the optical paths of the laser beams 14BK, 14M, 14C and 14Y which irradiate the surface of the photoconductive drums 9BK, 9M, 9C and 9Y.

In a case where no bearing 27 is provided and the rotary shaft 26 is fixed on the inner walls of the fixing unit 11, the polygon mirrors 20BK, 20M, 20C and 20Y are rotatably provided on the rotary shaft 26 or, the polygon mirrors 20BK, 20M, 20C and 20Y and the covering members 20SMK, 20SCM and 20SYC are rotatably provided on the rotary shaft 26.

According to this third embodiment and the first and second modifications thereof, the common rotary axis 26 of the polygon mirrors 20BK, 20M, 20C and 20Y is separated from the rotary axes of the photoconductive drums 9BK, 9M, 9C and 9Y by identical distances along respective normals which are perpendicular to both the common rotary axis 26 of the polygon mirrors 20BK, 20M, 20C and 20Y and a corresponding one of the plurality of rotary axes of the photoconductive drums 9BK, 9M, 9C and 9Y. The rotary axes of the photoconductive drums 9BK, 9M, 9C and 9Y are arranged parallel to each other. By using this arrangement, each of the laser beams 14BK, 14M, 14C and 14Y reflected by the corresponding polygon mirrors 20BK, 20M, 20C and 20Y can be irradiated on the surface of the corresponding photoconductive drums 9BK, 9M, 9C and 9Y without being intermediated by an optical system 22 which includes a deflection mirror 222. For this reason, it is possible to prevent the amount of positional error from increasing with increasing temperature within the exposure unit 11, which would otherwise be caused by a change in the inclination of the deflection mirror 222. As a result, it is unnecessary to frequently perform the positional error correction with respect to the exposure unit 11 of the image forming apparatus 100, and the down-time of the image forming apparatus 100 caused by the positional error correction can be reduced. Consequently, it is possible to form a stable full color image without deteriorating the performance of the image forming apparatus 100 from the point of view of the user.

Of course, the lens 24A of the second embodiment described above may be employed in the third embodiment and the first and second modifications thereof. In this case, the optical systems 22BK, 22M, 22C and 22Y shown in FIGS. 12 and 13 may be omitted.

The control program which controls the image forming operation described above may be written in codes of a programming language corresponding to the operating environment (or platform) of the control system which executes the control process, and stored in any suitable computer-readable storage media. The control program may be installed to the image forming apparatus 10 from such computer-readable storage media via an interface capable of reading such computer-readable storage media. The computer-readable storage media is not limited to particular types of media, and may include floppy disks (registered trademark), compact disks (CDs), digital versatile disks (DVDs), and semiconductor memory devices such as flash memories and universal serial bus (USB) memories.

The image forming apparatus 100 may be provided with a data communication interface (not shown) which is connectable to a data transmission path such as a network. In this case, the control program may be downloaded from a communication line such as the Internet and installed to the image forming apparatus 100 via the data communication interface.

The shapes of the various parts are of course not limited to those of the described embodiments and modifications, and the embodiments and modifications may be appropriately combined to obtain a desired feature.

This application claims the benefit of Japanese Patent Applications No. 2008-048162 filed February 28, 2008 and No. 2009-011935 filed Jan. 22, 2009, in the Japanese Patent Office, the disclosures of which are hereby incorporated by reference.

Further, the present invention is not limited to these embodiments, but various variations and modifications may be made without departing from the scope of the present invention.

What is claimed is:

1. An exposure unit for exposing a plurality of photoconductive drums having rotary axes thereof arranged parallel to each other on a single plane by a plurality of light beams emitted from a plurality of light sources, each of said plurality of photoconductive drums having a surface to be exposed when forming an electrostatic latent image thereon, said exposure unit comprising:

one or a plurality of polygon mirrors each having a plurality of reflection surfaces, said one or the plurality of polygon mirrors being configured to rotate about a common rotary axis, wherein each of the plurality of light beams emitted from the plurality of light sources is deflected by said one or a corresponding one of the plurality of polygon mirrors and scans the surface of a corresponding one of the plurality of photoconductive drums, wherein at least one of a light emission period and a light emission amount of each of the plurality of light beams emitted from the plurality of light sources is controlled depending on an image height of the electrostatic latent image formed on the surface of each of the plurality of photoconductive drums, and the common rotary axis of said one of the plurality of polygon mirrors is separated from the rotary axes of the plurality of photoconductive drums by identical distances along respective normals which are perpendicular to both the common rotary axis and a corresponding one of the plurality of rotary axes.

2. The exposure unit as claimed in claim 1, further comprising:

an optical system disposed in an optical path between the reflection surface of said one or the plurality of polygon mirrors and a corresponding one of the photoconductive drums, wherein the optical system excludes a mirror.

3. The exposure unit as claimed in claim 2, wherein the optical system includes a lens configured to control a beam spot diameter of a corresponding one of the plurality of light beams on the surface of a corresponding one of the plurality of photoconductive drums.

4. The exposure unit as claimed in claim 3, wherein the lens is formed by a fθ-lens.

5. The exposure unit as claimed in claim 1, further comprising:

a lens disposed in an optical path between a source of a corresponding one of the light beams and the reflection surface of said one or the plurality of polygon mirrors, wherein the lens has a focal distance variable in response to a control signal.

6. The exposure unit as claimed in claim 1, further comprising:

a covering member connecting two mutually adjacent polygon mirrors.

7. The exposure unit as claimed in claim 6, further comprising:

a magnetic force applying part configured to surround and apply a magnetic force on at least one of the polygon mirrors and/or at least one covering member in order to unitarily rotate the plurality of polygon mirrors, wherein the at least one of the polygon mirrors and/or at least one covering member surrounded by the magnetic force applying part is made of a magnetic material.

8. An image forming apparatus comprising:

a plurality of light sources configured to emit a plurality of light beams;

one or a plurality of polygon mirrors each having a plurality of reflection surfaces, said one or the plurality of polygon mirrors being configured to rotate about a common rotary axis;

a plurality of photoconductive drums having rotary axes thereof arranged parallel to each other on a single plane, each of said plurality of photoconductive drums having a surface to be exposed when forming an electrostatic latent image thereon;

a controller configured to control at least one of a light emission period and a light emission amount of each of the plurality of light beams emitted from the plurality of light sources depending on an image height of the electrostatic latent image formed on the surface of each of the plurality of photoconductive drums; and a plurality of image forming units each forming a toner image of one of a plurality of different colors on the surface of a corresponding one of the plurality of photoconductive drums in order to make the electrostatic latent image visible, wherein each of the plurality of light beams emitted from the plurality of light sources is deflected by said one or a corresponding one of the plurality of polygon mirrors and scans the surface of a corresponding one of the plurality of photoconductive drums, and the common rotary axis of said one of the plurality of polygon mirrors is separated from the rotary axes of the plurality of photoconductive drums by identical distances along respective normals which are perpendicular to both the common rotary axis and a corresponding one of the plurality of rotary axes.

9. The image forming apparatus as claimed in claim 8, further comprising:

an optical system disposed in an optical path between the reflection surface of said one or the plurality of polygon mirrors and a corresponding one of the photoconductive drums, wherein the optical system excludes a mirror.

10. The image forming apparatus as claimed in claim 9, wherein the optical system includes a lens configured to control a beam spot diameter of a corresponding one of the plurality of light beams on the surface of a corresponding one of the plurality of photoconductive drums.

11. The image forming apparatus as claimed in claim 10, wherein the lens is formed by a fθ-lens.

12. The image forming apparatus as claimed in claim 8, further comprising:

a lens disposed in an optical path between a source of a corresponding one of the light beams and the reflection surface of said one or the plurality of polygon mirrors, wherein the lens has a focal distance variable in response to a control signal.

13. The image forming apparatus as claimed in claim 12, further comprising:

a detecting mechanism configured to detect a scan timing of each of the plurality of light beams irradiated on the surfaces of the corresponding photoconductive drums; and a control unit configured to generate the control signal based on the scan timing that is detected.

14. The image forming apparatus as claimed in claim 8, wherein the controller controls the light emission period of each of the plurality of light beams emitted from the plurality of light sources to be longer in a vicinity of a center along an axial direction of each of the plurality of photoconductive drums than in a vicinity of both ends along the axial direction of each of the plurality of photoconductive drums.

15. The image forming apparatus as claimed in claim 8, wherein the controller controls the light emission amount of each of the plurality of light beams emitted from the plurality of light sources so that a light reception intensity is controlled to a constant level on the surface of each of the plurality of photoconductive drums.

16. The image forming apparatus as claimed in claim 8, further comprising:

a detecting mechanism configured to detect an inclination of the common rotary axis relative to a reference plane; and a controller configured to control the inclination to fall within a predetermined range.

17. The image forming apparatus as claimed in claim 8, further comprising:

a covering member connecting two mutually adjacent polygon mirrors.

18. The image forming apparatus as claimed in claim 17, further comprising:

a magnetic force applying part configured to surround and apply a magnetic force on at least one of the plurality of polygon mirrors and/or at least one covering member in order to unitarily rotate the plurality of polygon mirrors, wherein the at least one of the polygon mirrors and/or at least one covering member surrounded by the magnetic force applying part is made of a magnetic material.

19. An image forming method which forms a color image according to a tandem system, comprising:

emitting a plurality of light beams from a plurality of light sources;

uniformly charging a surface of each of a plurality of photoconductive drums having rotary axes thereof arranged parallel to each other on a single plane;

deflecting the plurality of light beams emitted from the plurality of light sources from one or a plurality of polygon mirrors each having a plurality of reflection surfaces and scanning the surface of each of the plurality of photoconductive drums to form an electrostatic latent image on the surface, said one or the plurality of polygon mirrors being configured to rotate about a common rotary axis which is separated from the rotary axes of the plurality of photoconductive drums by identical distances along respective normals which are perpendicular to both the common rotary axis and a corresponding one of the plurality of rotary axes;

controlling at least one of a light emission period and a light emission amount of each of the plurality of light beams emitted from the plurality of light sources depending on an image height of the electrostatic latent image formed on the surface of each of the plurality of photoconductive drums; and forming a toner image of one of a plurality of different colors on the surface of a corresponding one of the plurality of photoconductive drums in order to make the electrostatic latent image visible.

20. The image forming method as claimed in claim 19, wherein said deflecting deflects each of the plurality of light beams via an optical system which is disposed in an optical path between the reflection surface of a corresponding one said one or the plurality of polygon mirrors and a corresponding one of the photoconductive drums, and the optical system excludes a mirror.

21. The image forming method as claimed in claim 19, wherein the controlling controls the light emission period of each of the plurality of light beams emitted from the plurality of light sources to be longer in a vicinity of a center along an axial direction of each of the plurality of photoconductive drums than in a vicinity of both ends along the axial direction of each of the plurality of photoconductive drums.

22. The image forming method as claimed in claim 19, wherein the controlling controls the light emission amount of each of the plurality of light beams emitted from the plurality of light sources so that a light reception intensity is controlled to a constant level on the surface of each of the plurality of photoconductive drums.

23. An image forming apparatus comprising:

a plurality of light sources configured to emit a plurality of light beams;

a single polygon mirror having a plurality of reflection surfaces and configured to rotate about a common rotary axis;

a plurality of photoconductive drums having rotary axes thereof arranged parallel to each other on a single plane, each of said plurality of photoconductive drums having a surface to be exposed when forming an electrostatic latent image thereon; and a plurality of image forming units each forming a toner image of one of a plurality of different colors on the surface of a corresponding one of the plurality of photoconductive drums in order to make the electrostatic latent image visible, wherein each of the plurality of light beams emitted from the plurality of light sources is deflected by the polygon mirror and scans the surface of a corresponding one of the plurality of photoconductive drums, and the common rotary axis of the polygon mirror is separated from the rotary axes of the plurality of photoconductive drums by identical distances along respective normals which are perpendicular to both the common rotary axis and a corresponding one of the plurality of rotary axes.

* * * * *